US012669303B2

(12) United States Patent
Provorse

(10) Patent No.: US 12,669,303 B2
(45) Date of Patent: Jun. 30, 2026

(54) FIREARM SUPPRESSOR WITH GAS RECIRCULATION AND MODULAR COMPONENTS

(71) Applicant: Echo Zulu Defense, LLC, Sturgis, SD (US)

(72) Inventor: Paul Provorse, Sturgis, SD (US)

(73) Assignee: Echo Zulu Defense, LLC, Sturgis, SD (US)

( * ) Notice: Subject to any disclaimer, the term of this patent is extended or adjusted under 35 U.S.C. 154(b) by 0 days.

(21) Appl. No.: 19/422,279

(22) Filed: Dec. 16, 2025

(65) Prior Publication Data

US 2026/0104220 A1 Apr. 16, 2026

Related U.S. Application Data

(63) Continuation-in-part of application No. 19/085,822, filed on Mar. 20, 2025.

(60) Provisional application No. 63/567,675, filed on Mar. 20, 2024.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/36; F41A 25/00
See application file for complete search history.

(56) References Cited

U.S. PATENT DOCUMENTS

| | | | | |
|---|---|---|---|---|
| 3,500,955 | A * | 3/1970 | Werbell, III | F41A 21/30 181/223 |
| 3,667,570 | A * | 6/1972 | WerBell, III | F41A 21/30 89/14.4 |
| 4,459,895 | A | 7/1984 | Mazzanti | |
| 4,576,083 | A * | 3/1986 | Seberger, Jr. | F01N 1/08 89/14.4 |
| 6,575,074 | B1 * | 6/2003 | Gaddini | F41A 21/30 89/14.4 |
| 7,832,323 | B1 | 11/2010 | Davies | |
| 8,522,662 | B2 | 9/2013 | Presz, Jr. et al. | |
| 8,844,422 | B1 * | 9/2014 | Klett | F41A 21/34 89/14.4 |

(Continued)

FOREIGN PATENT DOCUMENTS

| | | | | |
|---|---|---|---|---|
| AU | 2022417294 | A1 | 7/2024 | |
| DE | 2014109 | A1 * | 9/1971 | F01N 1/06 |

(Continued)

*Primary Examiner* — Benjamin P Lee
(74) *Attorney, Agent, or Firm* — Stephen B. Katsaros; Patent Engineering, LLC

(57) ABSTRACT

The present disclosure provides a firearm suppressor comprising a proximal end configured to attach to a firearm barrel, a distal end, and a housing disposed between the proximal and distal ends. The housing may include a gas recirculation system that includes return tubes configured to redirect gas from the central chamber to the peripheral chamber, and injection tubes in fluid communication with the peripheral chamber and a receiving baffle to extend gas dwell time. The housing may include, in combination or separately, a helical path assembly. Other innovative aspects, such as an identification plate system, baffle features, support lattice, etc., are also disclosed.

20 Claims, 16 Drawing Sheets

(56) References Cited

U.S. PATENT DOCUMENTS

| | | | | |
|---|---|---|---|---|
| 8,875,612 | B1 * | 11/2014 | Klett | F41A 21/34 89/14.4 |
| 9,482,484 | B2 | 11/2016 | Barney | |
| 10,054,384 | B1 * | 8/2018 | Marfione | F41A 21/30 |
| 10,126,084 | B1 * | 11/2018 | Oglesby | F41A 21/30 |
| 10,480,889 | B1 | 11/2019 | Fan | |
| 10,502,513 | B2 | 12/2019 | Ellison et al. | |
| 10,634,445 | B1 * | 4/2020 | Klett | F41A 21/30 |
| 10,690,431 | B2 | 6/2020 | Washburn, III et al. | |
| 11,125,523 | B2 | 9/2021 | Petersen | |
| 11,428,489 | B2 | 8/2022 | Petersen | |
| 11,435,155 | B2 | 9/2022 | Washburn, III et al. | |
| 11,543,203 | B2 | 1/2023 | Moore et al. | |
| 11,680,764 | B1 * | 6/2023 | Bray | F41A 21/30 181/223 |
| 11,703,303 | B1 | 7/2023 | Bray | |
| 11,927,411 | B2 | 3/2024 | DeJessa | |
| 12,018,904 | B2 | 6/2024 | Berglund | |
| 2014/0318887 | A1 | 10/2014 | Latka | |
| 2017/0102202 | A1 * | 4/2017 | Augustine | F41A 21/30 |
| 2019/0072353 | A1 | 3/2019 | Slack | |
| 2019/0257607 | A1 * | 8/2019 | Dobrinescu | F41A 21/30 |
| 2020/0141679 | A1 | 5/2020 | Garst et al. | |
| 2022/0057160 | A1 | 2/2022 | Johns et al. | |
| 2022/0163281 | A1 | 5/2022 | Madigan et al. | |
| 2022/0276016 | A1 * | 9/2022 | Dueck | F41A 21/30 |
| 2022/0276017 | A1 | 9/2022 | Wilson | |
| 2023/0341207 | A1 * | 10/2023 | Bray | F41A 21/30 |
| 2024/0263905 | A1 * | 8/2024 | Washburn, III | F41A 21/30 |
| 2025/0130005 | A1 * | 4/2025 | Knott | F41A 21/30 |
| 2025/0264290 | A1 | 8/2025 | Sanders et al. | |
| 2025/0321069 | A1 * | 10/2025 | Dueck | F41A 21/30 |
| 2026/0009614 | A1 | 1/2026 | Bray | |

FOREIGN PATENT DOCUMENTS

| | | | | |
|---|---|---|---|---|
| FI | 20205767 | A1 | 1/2022 | |
| GB | 1301544 | A * | 12/1972 | F41A 21/30 |
| NO | 348766 | B | 5/2025 | |
| WO | 2020176182 | A1 | 9/2020 | |
| WO | 2022147454 | A1 | 7/2022 | |
| WO | 2024072329 | A1 | 4/2024 | |
| WO | 2024226399 | A1 | 10/2024 | |
| WO | 2025085589 | A1 | 4/2025 | |

* cited by examiner

FIREARM SUPPRESSOR WITH GAS RECIRCULATION AND MODULAR COMPONENTS

CROSS-REFERENCE TO RELATED APPLICATIONS

This application is a continuation-in-part (CIP) of U.S. application Ser. No. 19/085,822, titled "Firearm Suppressor with Low Signature Ventilation," filed Mar. 20, 2025, which claimed priority to 63/567,675 filed on Mar. 20, 2024, both of which are hereby incorporated by reference in their entirety.

TECHNICAL FIELD

This present disclosure relates to firearm suppressors, and more particularly to suppressors incorporating advanced gas management systems, modular components, and integrated auxiliary features for enhanced sound suppression, thermal management, and operational versatility.

BACKGROUND

Firearm suppressors reduce muzzle blast and flash by controlling the expansion and cooling of propellant gases as projectiles exit the barrel. Conventional suppressor designs typically employ linear gas flow pathways through a series of baffles or expansion chambers to achieve sound reduction. However, these traditional approaches often result in sub-optimal gas management, leading to reduced suppression effectiveness and increased back pressure that can affect firearm performance.

SUMMARY

Firearm suppressors are utilized across military, law enforcement, and civilian applications to reduce acoustic signatures and enhance operational effectiveness. Modern tactical operations demand suppressors that provide superior sound reduction while maintaining reliability under diverse conditions. Traditional suppressor designs often fail to maximize gas dwell time within the suppressor housing, resulting in suboptimal performance and increased back pressure that can affect firearm accuracy and reliability.

According to an aspect of the present disclosure, a gas recirculation system for a firearm suppressor is provided. The gas recirculation system includes a proximal end configured to attach to a firearm barrel and a distal end. A housing is disposed between the proximal end and the distal end. The housing includes a plurality of components, including a blast chamber adjacent to the proximal end and a receiving baffle disposed near the proximal end. The receiving baffle includes a plurality of ports formed through the receiving baffle. An inner tube adjoins the receiving baffle, wherein the inner tube separates a central chamber from a peripheral chamber. A terminal baffle adjoins both the inner tube and the distal end. The terminal baffle includes a neck oppositely disposed from the distal end. At least a first intermediary baffle is disposed between the receiving baffle and the terminal baffle in the central chamber. A bore pierces the proximal end, the distal end, and the plurality of components of the housing. A gas recirculation system includes a plurality of return tubes configured to redirect gas from the central chamber to the peripheral chamber, wherein the return tubes are formed on the terminal baffle and in fluid communication with the peripheral chamber. A plurality of injection tubes is in fluid communication with the peripheral chamber and the receiving baffle. The gas recirculation system directs gas at the terminal baffle and conveys the gas to the peripheral chamber via the plurality of return tubes and releases the gas to the receiving baffle via the plurality of injection tubes to extend gas dwell time within the firearm suppressor.

According to another aspect of the present disclosure, a helical path for a firearm suppressor is provided. The helical path includes a proximal end configured to attach to a firearm barrel and a distal end. A housing is disposed between the proximal end and the distal end. The housing includes a plurality of components, including a blast chamber adjacent to the proximal end and a first helical path adjacent to, and in fluid communication with, the blast chamber, wherein the first helical path is configured to receive gas directly from the blast chamber. A lattice adjoins the first helical path, wherein the lattice is configured to both support the first helical path and tubulate the gas, while a receiving baffle adjoins the lattice. The receiving baffle includes a plurality of ports formed through the receiving baffle. An inner tube adjoins the receiving baffle, wherein the inner tube separates a central chamber from a peripheral chamber. A terminal baffle adjoins both the inner tube and the distal end. The terminal baffle includes a neck oppositely disposed from the distal end, a plurality of windows formed in the neck, and an expansion cone bridging between the neck and the distal end. At least a first intermediary baffle is disposed between the receiving baffle and the terminal baffle in the central chamber. A bore pierces the proximal end, the distal end, and the plurality of components of the housing. The helical path extends the gas dwell time within the firearm suppressor.

According to another aspect of the present disclosure, a serial identification plate system for a firearm suppressor is provided. The system includes a suppressor housing and a removable serial identification plate. The removable serial identification plate includes a plate body having a serial number permanently marked thereon and attachment means for securing the plate body to the suppressor housing. The attachment means includes one or more welds configured to permanently attach the plate body to the suppressor housing during manufacturing. The one or more welds may be removed to detach the plate body from the suppressor housing for warranty repairs. The plate body is transferable to a replacement suppressor housing.

According to another aspect of the present disclosure, a firearm suppressor is provided. The firearm suppressor includes a suppressor housing having a proximal end configured for attachment to a firearm barrel and a distal end. A front cap is disposed at the distal end of the suppressor housing. The front cap includes a projectile exit aperture and a plurality of spikes integrally formed with the front cap and arranged in a predetermined pattern around the projectile exit aperture. The spikes extend outward from the front surface of the front cap. The spikes are configured to provide glass-breaking capability. The spikes are manufactured as integral components of the front cap.

Further areas of applicability of the present disclosure will become apparent from the detailed description provided hereinafter. It should be understood that the detailed description and specific examples, while indicating various configurations, are intended for purposes of illustration only and are not intended to limit the scope of the disclosure necessarily.

BRIEF DESCRIPTION OF THE DRAWINGS

The accompanying figures of the drawing, which are included to provide a further understanding of general aspects of the system/method, are incorporated in and constitute a part of this specification. These illustrative aspects of the system/method, together with the detailed description, explain the principles of the system. No attempt is made to show structural details in more detail than is necessary for a fundamental understanding of the system and the various ways in which it is practiced. The following figures of the drawing include.

Figure 1:
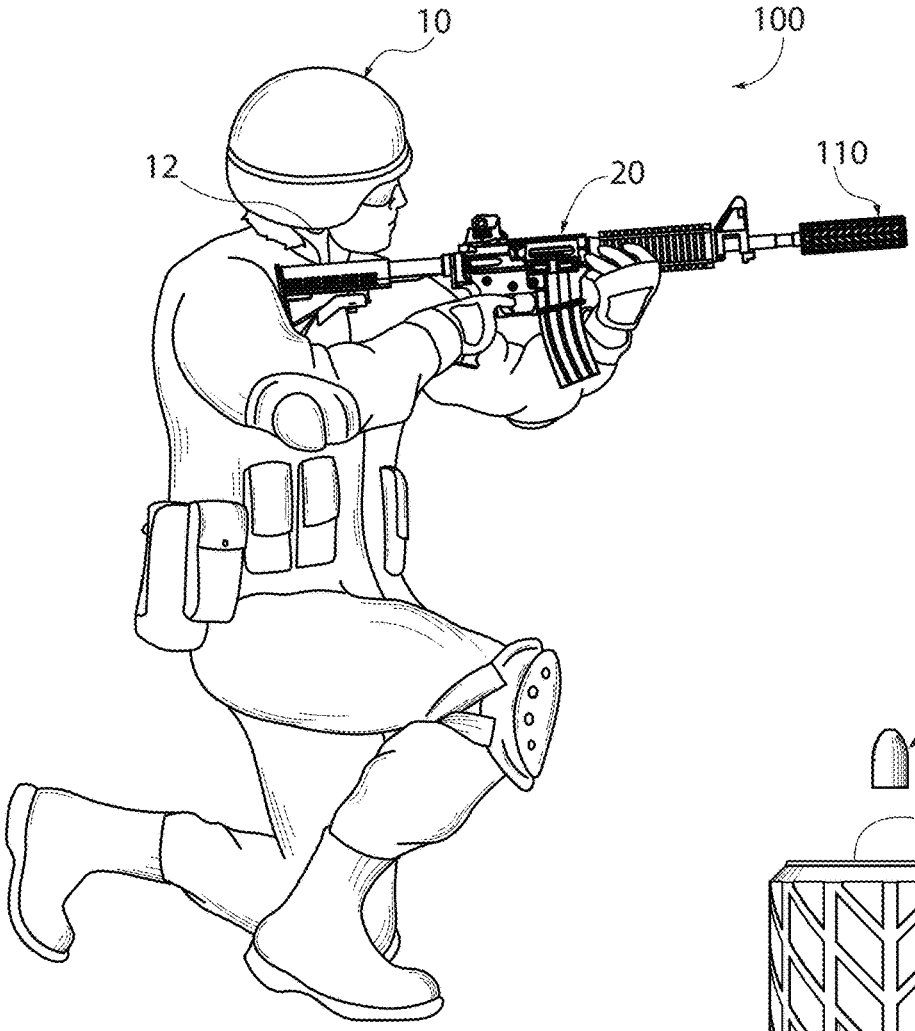
FIG. 1 illustrates a perspective view of a firearm fitted with a suppressor showing one example of operational context.

In the appended figures, similar components and/or features may have the same reference label. Further, various components of the same type may be distinguished by following the reference label with a dash and a second label that distinguishes among the similar components. If only the first reference label is used in the specification, the description applies to any one of the similar components having the same first reference label, irrespective of the second reference label. Where the reference label is used in the specification, the description is applicable to any one of the similar components having the same reference label.

DETAILED DESCRIPTION

Illustrative configurations are described with reference to the accompanying drawings. Wherever convenient, the same reference numbers are used throughout the drawings to refer to the same or similar parts. While examples and features of disclosed principles are described herein, modifications, adaptations, and other implementations are possible without departing from the spirit and scope of the disclosed configurations. It is intended that the following detailed description be considered illustrative only, with the true scope and spirit being indicated by the claims (presented now or introduced later).

Conventional firearm suppressors often suffer from significant limitations in gas management, heat dissipation, and operational versatility that compromise their effectiveness in diverse operational environments. Traditional suppressor designs typically feature linear gas flow pathways that result in suboptimal noise reduction, increased back pressure, and accelerated thermal buildup. These conventional systems fail to maximize gas dwell time within the suppressor housing, leading to reduced sound suppression performance and increased acoustic signature. Additionally, current suppressors manufactured using additive techniques present challenges for repairs and warranty service due to their single-piece construction and permanently affixed serial numbers, creating complex regulatory procedures when replacement becomes necessary. The lack of operational versatility in existing designs further limits their utility in tactical applications where directional gas control and auxiliary features may provide strategic advantages.

The disclosed firearm suppressor system addresses these limitations through an innovative combination of advanced gas management, modular components, and integrated thermal control systems that collectively enhance performance while maintaining structural integrity and regulatory compliance. The suppressor system may include a gas recirculation mechanism that utilizes curved pathways to redirect gases back into the suppressor's internal chamber, extending gas dwell time and enhancing sound suppression performance. The system may incorporate a modular serial identification plate that can be removed and transferred to replacement suppressor housings without complex regulatory procedures, particularly beneficial for suppressors manufactured using additive techniques. The disclosed system may feature rotatable ventilation control that enables users to direct gas discharge through adjustable side ports, providing tactical advantages through customizable gas dispersion patterns. Additionally, the suppressor system may include integrated auxiliary features such as glass-breaking spikes and sophisticated thermal management components that address heat buildup while maintaining operational effectiveness in confined installation environments.

FIG. 1 illustrates a perspective view of a firearm fitted with a suppressor 100, showing the operational context and practical application of the disclosed suppressor system. The perspective view of a firearm fitted with a suppressor 100 demonstrates how the suppressor technology integrates with standard firearm platforms during tactical operations. A soldier 10 may be positioned in a kneeling stance while operating a firearm 20 equipped with a suppressor 110, illustrating the real-world deployment scenario for the disclosed suppressor system. The soldier 10 may be in a tactical firing position, demonstrating the operational context in which the suppressor system provides acoustic protection and performance enhancement. The soldier 10 may wear standard tactical gear, but often the soldier's ears 12 may be exposed during firing. The ear 12 represents the target for acoustic protection that the suppressor 110 addresses by reducing the total acoustical energy emitted during firing operations.

The firearm 20 may include a standard rifle platform configured to accept the suppressor 110 at the muzzle end. The firearm 20 can be equipped with various tactical accessories and may maintain standard operational characteristics when fitted with the suppressor 110. The integration between the firearm 20 and suppressor 110 demonstrates the seamless attachment capability that allows the suppressor system to enhance firearm performance without compromising operational effectiveness. In an illustrative configuration, the suppressor 110 may extend forward from the muzzle of the firearm 20 and can be positioned in alignment with the barrel axis.

Figure 2:
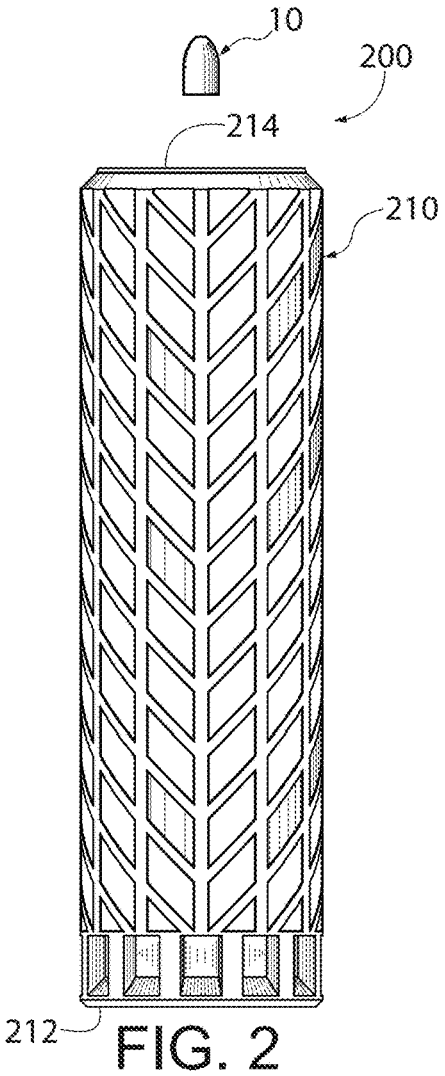
FIG. 2 illustrates a side elevation view of a firearm suppressor with a projectile trajectory.

FIG. 2 illustrates a side elevation view 200 of a firearm suppressor 210. A projectile 22 is provided to illustrate a trajectory path through the suppressor assembly. An outer tube 211 may form the exterior housing of the firearm suppressor 210, providing structural containment for internal suppression components. The firearm suppressor 210 may be configured with a proximal end 212 configured with attachment features that facilitate secure mounting to a firearm barrel. The proximal end 212 may include threaded connections or other mechanical interfaces that ensure proper alignment and gastight sealing between the firearm suppressor 210 and the host weapon system. A distal end 214 may provide an exit point for both projectiles and residual gases, with the distal end 214 positioned opposite to the proximal end 212 along the longitudinal axis of the firearm suppressor 210. The outer tube 211 may display external surface features that contribute to both functional and aesthetic aspects of the firearm suppressor 210. The outer tube 211 may include textured patterns, heat dissipation features, or tool engagement surfaces that facilitate installation and removal operations. The side elevation view 200 may reveal the overall proportions and external geometry of the firearm suppressor 210, demonstrating how the outer tube 211 maintains a consistent diameter along the length between the proximal end 212 and the distal end 214.

In an illustrative configuration, the projectile 22 may travel along a central bore pathway that extends through the entire length of the firearm suppressor 210. The projectile 22 may pass through the proximal end 212, traverse the internal suppression chambers, and exit through the distal end 214 without interference from the suppression components.

Figure 3:
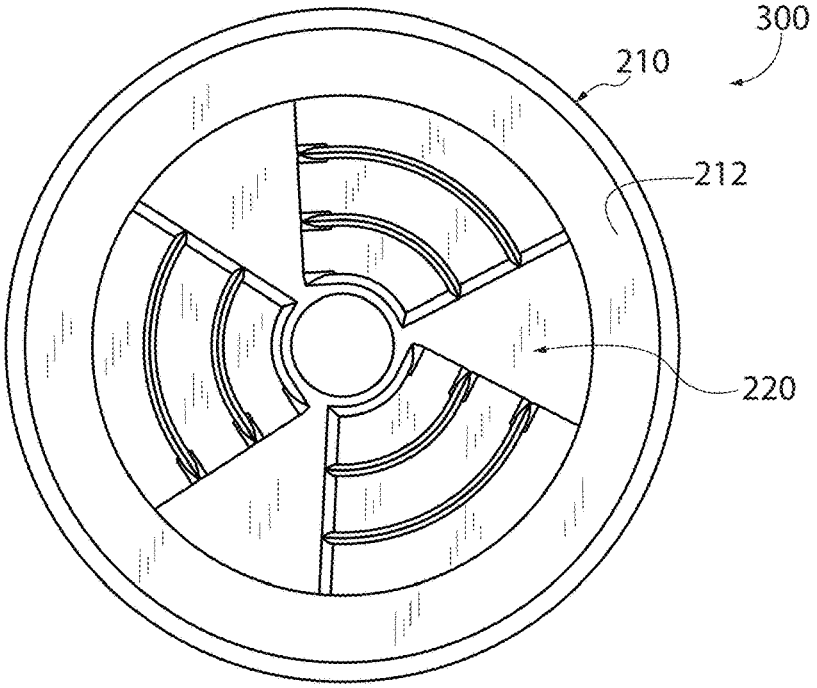
FIG. 3 illustrates an end view of the firearm suppressor showing the proximal end.

FIG. 3 illustrates an end view 300 of the firearm suppressor 210 showing the proximal end 212 configuration and associated inlet features. The end view 300 may provide a perspective looking directly at the proximal end 212 of the firearm suppressor 210, revealing the circular cross-sectional profile of the outer tube 211. An inlet 310 may be positioned at the center of the proximal end 212, providing an entry point for propellant gases from the firearm barrel into the internal chambers of the firearm suppressor 210. The inlet 310 may comprise a circular aperture that aligns with the bore of the firearm barrel when the firearm suppressor 210 is properly mounted. The inlet 310 may be dimensioned to accommodate the passage of projectiles while providing sufficient clearance to prevent contact between the projectile 22 and the inlet 310 walls during firing operations. The proximal end 212 may include mounting features surrounding the inlet 310 that facilitate secure attachment to the firearm barrel. The end view 300 may reveal the external configuration of the proximal end 212, showing how the outer tube 211 terminates at the mounting interface. The proximal end 212 may include threaded surfaces, alignment features, or sealing elements that ensure proper connection to the host firearm. Additionally, the end view 300 may demonstrate the concentricity between the inlet 310 and the outer tube 211, ensuring that the projectile 22 pathway remains aligned with the longitudinal axis of the firearm suppressor 210 throughout the suppression process.

Figure 4:
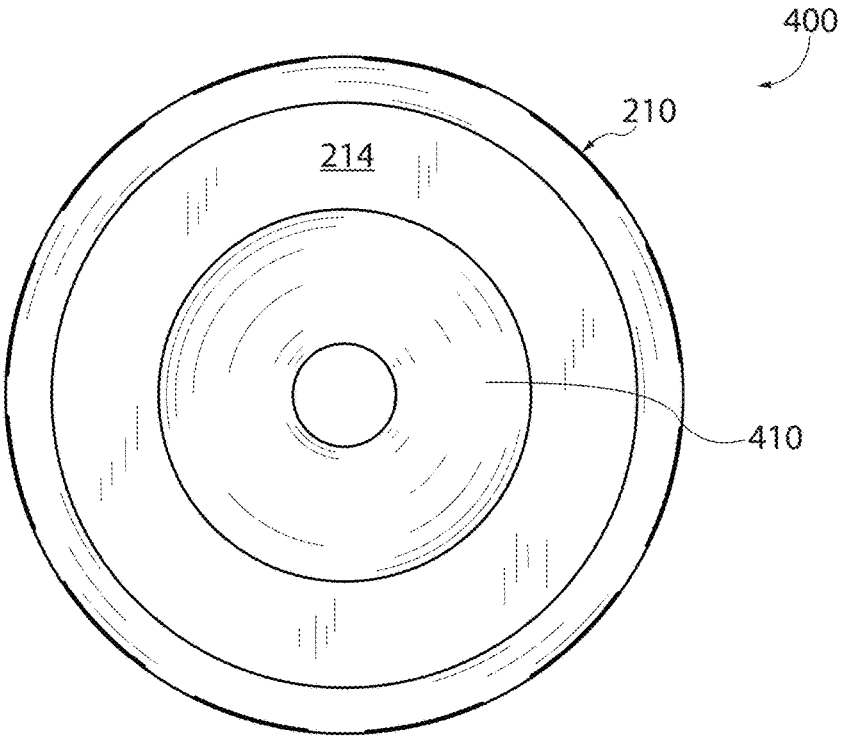
FIG. 4 illustrates an end view of the firearm suppressor showing the distal end with gas exit.

FIG. 4 illustrates an end view 400 of a firearm suppressor 210 showing the distal end 214. The firearm suppressor 210 may extend longitudinally and terminate at the distal end 214, which can provide an exit point for projectiles and gas during operation. The end view 400 may display the circular profile of the firearm suppressor 210 at the distal end 214, demonstrating the cylindrical configuration of one configuration of the suppressor housing. The distal end 214 may include a gas and projectile exit 410 that can be visible on the side surface of the firearm suppressor 210. The gas and projectile exit 410 may be positioned to allow gas to exit the suppressor in a direction perpendicular to the longitudinal axis of the firearm suppressor 210. This lateral positioning of the gas and projectile exit 410 can facilitate the directional discharge of gases away from the central bore while maintaining the structural integrity of the distal end 214.

Figure 5:
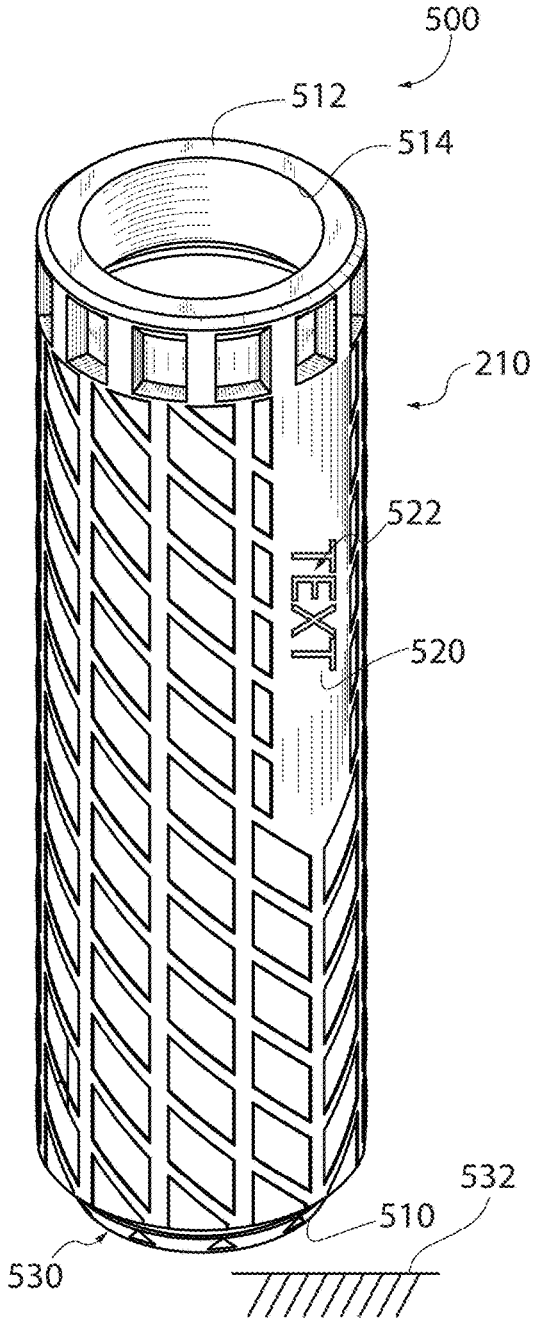
FIG. 5 illustrates a perspective view of a suppressor assembly and an associated buildplate interfacing with an end configuration for additive manufacturing processes.

FIG. 5 illustrates a perspective view 500 of the firearm suppressor 210 interacting with a representation of a build plate wherein a buildplate end 510 and an unsupported end 512 of a firearm suppressor component configured for additive manufacturing processes. The buildplate end 510 may be positioned at a proximal portion of the suppressor assembly and may be configured to interface with the buildplate 532 during Direct Metal Laser Sintering (DMLS) fabrication. The unsupported end 512 may extend longitudinally from the buildplate end 510 and may represent the distal portion of the suppressor component that extends away from the buildplate 532 during the additive manufacturing process. The buildplate end 510 may include fastening threads 514 formed on an exterior surface of the component. The fastening threads 514 may be configured to facilitate attachment to a firearm barrel or mounting interface and may be manufactured as integral features during the DMLS process. The buildplate end 510 may further include an indicia plate 520 positioned on the exterior surface. The indicia plate 520 may include markings 522 that provide identification information such as serial numbers, manufacturer details, or regulatory compliance data. The markings 522 may be permanently inscribed on the surface of the indicia plate 520 to ensure traceability and legal compliance throughout the service life of the suppressor. The indicia plate 520 may be manufactured as an integral component of the buildplate end 510 during the additive manufacturing process, eliminating the need for secondary assembly operations. Alternatively, the markings 522 may be applied in a secondary operation (e.g., etching by laser or chemical, machining, etc.)

A build raft 530 may be attached to the buildplate end 510 and may serve as a support structure during the additive manufacturing process. The build raft 530 may anchor the suppressor component during layer-by-layer fabrication and may provide stability to prevent warping or distortion during the thermal cycling inherent in DMLS processes. The build raft 530 may be connected to the buildplate 532, which may serve as the foundation surface for the additive manufacturing process. The buildplate 532 may provide a stable platform upon which the suppressor component can be constructed using titanium alloys, nickel-chromium superalloy, or stainless steel materials. In an illustrative configuration, the additive manufacturing orientation may be selected to minimize support structures while maintaining dimensional accuracy of functional features. The buildplate end 510 may be oriented toward the buildplate 532 to provide maximum support for the fastening threads 514 and the indicia plate 520 during fabrication. The unsupported end 512 may extend upward from the buildplate 532, allowing for the formation of internal geometries without requiring extensive support material that would be difficult to remove during post-processing operations.

Figure 6:
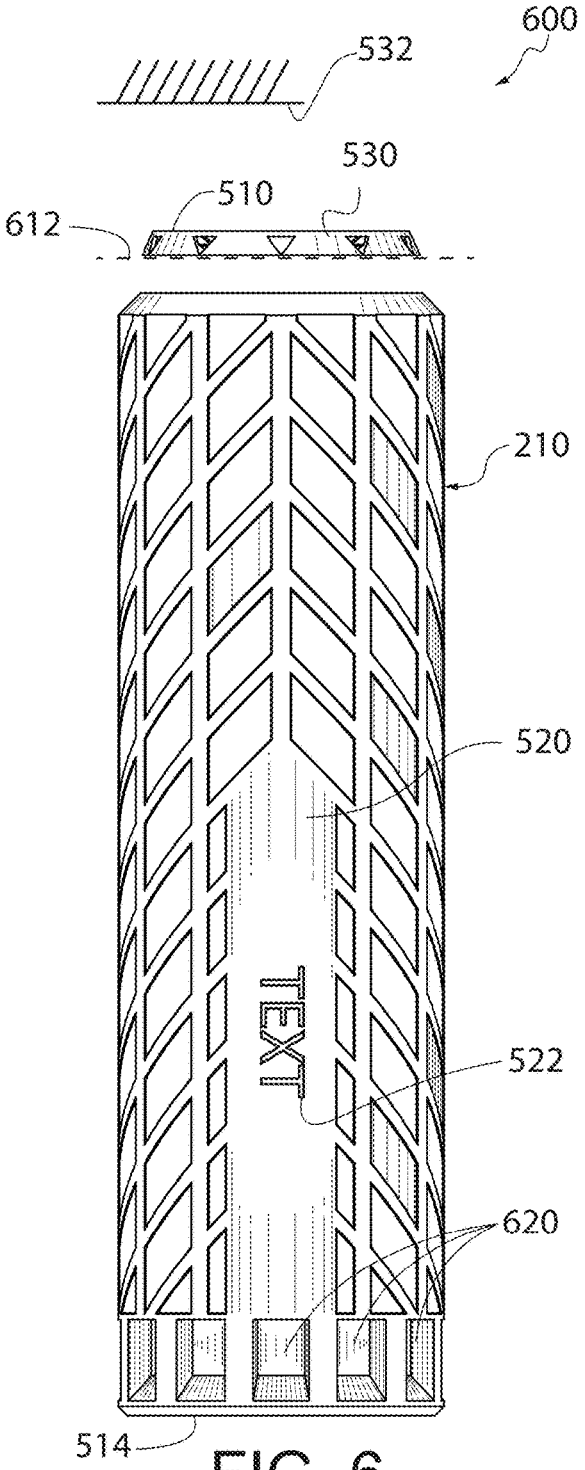
FIG. 6 illustrates a side view of the suppressor assembly (in a rotated orientation 180 degrees from FIG. 5), showing manufacturing support structures.

FIG. 6 illustrates a side view 600 of the suppressor assembly showing additional manufacturing details and post-processing considerations. The side view 600 may reveal a cut plane 612 indicated on the suppressor assembly, showing a location where a cut may be made to remove the build raft 530 from the finished component. The cut plane 612 may be positioned to allow for clean separation of the build raft 530 using traditional machining methods such as a saw, endmill, or lathe operations. The removal of the build raft 530 along the cut plane 612 may be performed during post-processing to prepare the suppressor for final finishing operations.

The side view 600 may further show wrench flats 620 formed on the exterior surface of the buildplate end 510. The wrench flats 620 may provide surfaces for tool engagement (e.g., a spanner wrench) during installation or removal of the suppressor assembly from a firearm barrel. The wrench flats 620 may be manufactured as integral features during the DMLS process, eliminating the need for secondary machining operations. The wrench flats 620 may be positioned to provide adequate clearance for standard tools while maintaining the structural integrity of the fastening threads 514. The manufacturing support structures disclosed may facilitate the production of complex internal geometries that would be difficult or impossible to achieve using traditional manufacturing methods. The build raft 530 and buildplate 532 may enable the fabrication of intricate baffle configurations, gas flow pathways, and recirculation systems as integral components of the suppressor housing. During post-processing operations, the build raft 530 may be removed along the cut plane 612, and the remaining surfaces may be finished to final specifications using conventional machining techniques. In an illustrative configuration, components may alternatively be manufactured using traditional CNC or lathe technology when additive manufacturing capabilities are not available or when production volumes justify conventional manufacturing approaches. Materials for the suppressor components may include nickel-chromium superalloy for high-temperature applications, 17-4 stainless steel for corrosion resistance, grade 5 titanium for weight reduction, or aluminum for lower-pressure caliber applications. The material selection may depend on the specific caliber rating and strength requirements of the intended application, with each material offering distinct advantages in terms of thermal properties, weight, and manufacturing cost considerations.

Figure 7:
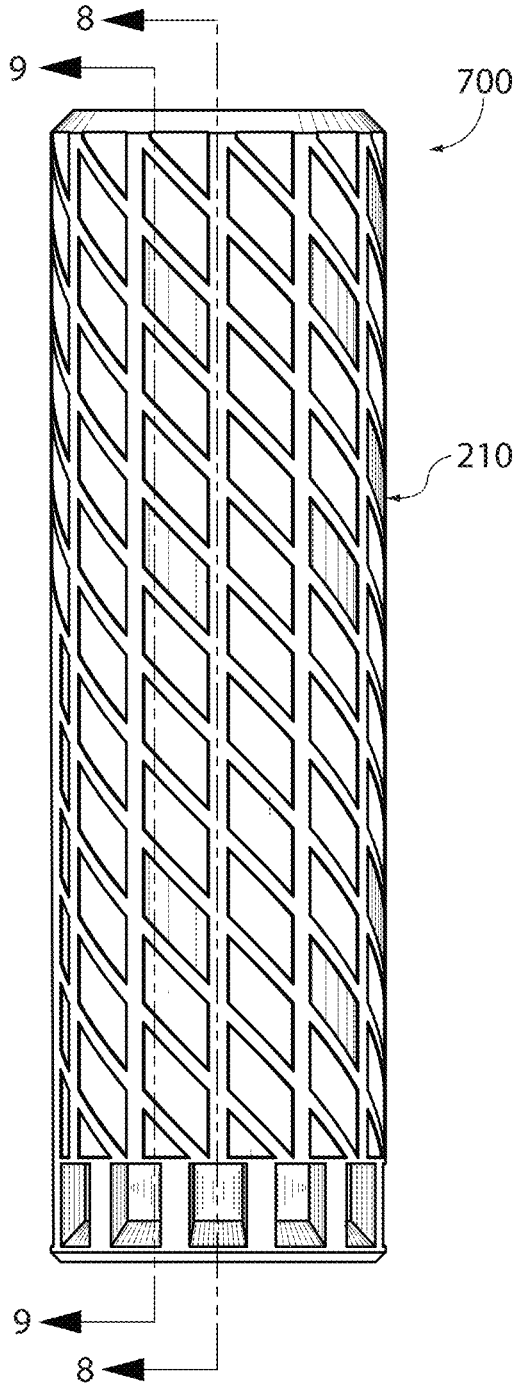
FIG. 7 illustrates a side elevation view of the firearm suppressor in the rotated orientation of FIG. 6 and with the manufacturing support structure removed therefrom.

FIG. 7 illustrates a side elevation view 700 of a firearm suppressor 210 in a rotated orientation. The firearm suppressor 210 may extend longitudinally from a proximal end to a distal end, presenting a cylindrical profile that maintains structural integrity while providing sound suppression functionality. The side elevation view 700 may demonstrate the external configuration of the firearm suppressor 210 and may reveal various cross-sectional planes that can be utilized in subsequent detailed views for comprehensive analysis of internal components. The firearm suppressor 210 may include a cylindrical housing that forms the primary structural element of the assembly. The cylindrical housing may maintain a substantially uniform diameter along the length of the firearm suppressor 210, providing consistent internal volume for gas management and sound suppression operations.

In an illustrative configuration, the engravings may serve as gripping points for user rotation or removal of the firearm suppressor 210. The textured surface created by the engravings may provide enhanced grip characteristics that allow operators to securely grasp and manipulate the firearm suppressor 210 during installation, adjustment, or removal procedures. The gripping points may be particularly beneficial when the firearm suppressor 210 becomes heated during use, as the textured surface may maintain tactile engagement even when wearing protective gloves.

Figure 8:
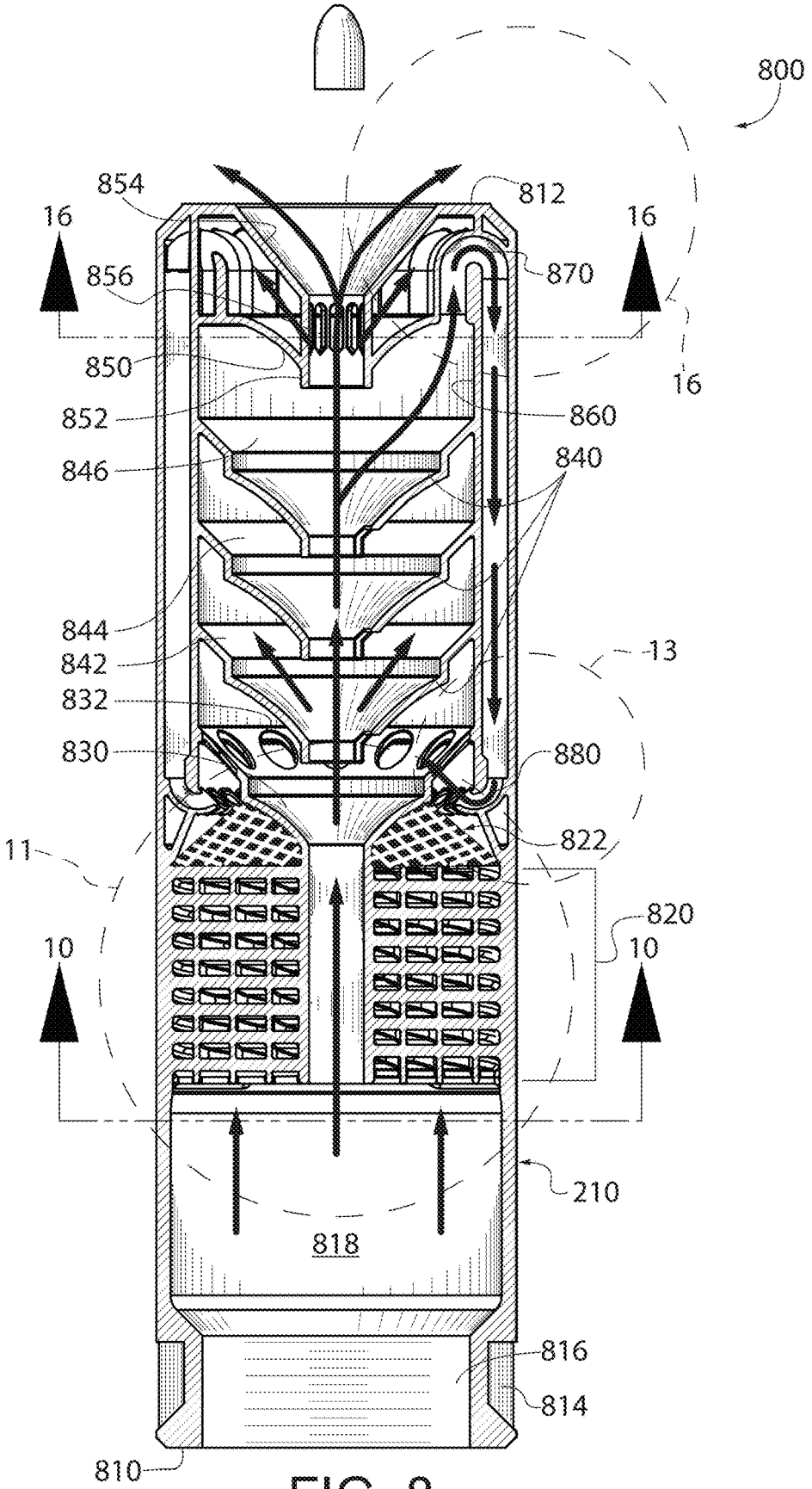
FIG. 8 illustrates a cross-sectional view of the firearm suppressor taken across plane 8-8 (FIG. 7), revealing internal gas management components.

FIG. 8 illustrates a cross-sectional view 800 of a firearm suppressor 210, revealing one configuration of the complete internal architecture and gas flow management system. The cross-sectional view 800 extends from a proximal end 810 configured to attach to a firearm barrel to a distal end 812 that provides an exit point for projectiles and gases. The firearm suppressor 210 may include wrench flats 814 formed on the exterior surface near the proximal end 810 to facilitate installation and removal operations. Threads 816 may be disposed on the proximal end 810 to provide a threaded connection mechanism for attachment to a firearm barrel or mounting interface. The firearm suppressor 210 may include a blast chamber 818 positioned adjacent to the proximal end 810. The blast chamber 818 may be configured to receive propellant gases from the firearm barrel and provide an initial expansion zone for high-pressure gases. A helical path assembly 820 may be disposed adjacent to the blast chamber 818 and in fluid communication with the blast chamber 818. The helical path assembly 820 may include a lattice 822 and a helical coil 826. The lattice 822 may be configured to support the helical path assembly 820 during additive manufacturing processes and to tubulate gas flow by increasing turbulence. The helical coil 826 may direct gases through a spiral pathway to reduce velocity and enhance sound suppression performance.

A receiving baffle 830 may be disposed downstream from the helical path assembly 820 and near the proximal end 810. The receiving baffle 830 may be an advanced cone style with a plurality of ports 832 formed through the receiving baffle 830. The plurality of ports 832 may be arranged in a pattern configured to direct gas flow radially inward from a peripheral chamber to a central chamber. The receiving baffle 830 may also include a central bore 834 that provides a passage for projectile travel. An inner tube 860 may adjoin the receiving baffle 830 and extend longitudinally through the firearm suppressor 210. The inner tube 860 may separate a central chamber 884 from a peripheral chamber 889 along at least half of the firearm suppressor 210.

In an illustrative configuration, the firearm suppressor 210 may include a plurality of intermediate baffles 840 disposed between the receiving baffle 830 and a terminal baffle within the central chamber 884. The plurality of intermediate baffles 840 may include a first intermediate baffle 842, a second intermediate baffle 844, and a third intermediate baffle 846. Each of the intermediate baffles may include a conical surface 841 that directs gas flow through the central chamber 884. The intermediate baffles may be configured as conical baffles having a central bore opening and an outer perimeter, wherein the conical baffles direct gas flow around the outer perimeter before passing through the central bore opening. One, some, or all of the plurality of intermediate baffles 840 may include a tapered conical section that encourages downward movement of gases onto a shelf below, increasing turbulence of the gases around the conical structure, with the gases being forced to rotate around the outer perimeter of the cones before traveling back through the central bore opening.

The terminal baffle 850 may adjoin both the inner tube 860 and the distal end 812. The terminal baffle 850 may include a neck 852 oppositely disposed from the distal end 812. An expansion cone 854 may bridge between the neck 852 and the distal end 812, providing a transition for gas flow and projectile passage. A plurality of windows 856 may be formed in the neck 852 to facilitate gas flow through the terminal baffle 850. The plurality of windows 856 may be distributed around the circumference of the neck 852 to provide openings through which gases can pass.

A plurality of return tubes 870 may be formed on the terminal baffle 850 and arranged circumferentially around the neck 852. The plurality of return tubes 870 may be configured to redirect gas from the central chamber 884 to the peripheral chamber 889. Each return tube may include a return tube inlet 872 positioned to receive gas from the central chamber 884 and a curved pathway 876 that redirects the gas flow. The curved pathway 876 may be configured to redirect gas flow at least 100 degrees from the central chamber 884 to the peripheral chamber 889. The plurality of return tubes 870 may be in fluid communication with the peripheral chamber 889 to facilitate gas recirculation within the firearm suppressor 210.

In an illustrative configuration, a plurality of injection tubes 880 may be positioned within the firearm suppressor 210 and in fluid communication with both the peripheral chamber 889 and the receiving baffle 830. The plurality of injection tubes 880 may include an injection tube inlet 882 in fluid communication with the peripheral chamber 889 and an injection tube outlet 879 that releases gas near the receiving baffle 830. The plurality of injection tubes 880 may be positioned to release gas from the peripheral chamber 889 into a region between the blast chamber 818 and the receiving baffle 830, wherein the released gas mixes with gas flowing from the blast chamber 818 to extend gas dwell time within the firearm suppressor 210.

A bore 890 may extend through the proximal end 810, the distal end 812, and all components of the firearm suppressor 210, providing a continuous passage for projectile travel. The bore 890 may pierce the proximal end 810, the distal end 812, and the plurality of components of the housing to maintain a clear trajectory path through the suppressor assembly. The gas recirculation system may direct gas at the terminal baffle 850 and convey the gas to the peripheral chamber 889 via the plurality of return tubes 870, then release the gas to the receiving baffle 830 via the plurality of injection tubes 880 to extend gas dwell time within the firearm suppressor 210. This recirculation system may enhance sound suppression performance by increasing the time gases remain within the suppressor before exiting.

Additionally, the helical path assembly 820 may incorporate acoustic-changing features by modifying angles of coils and distance between spirals to create destructive interference and cancel specific frequencies in the sound waves. The baffle modules may be modified by adding smaller slotted holes on the inside faces to reduce heat buildup and weight while maintaining similar suppression results. Moreover, the reverse gas flow chamber may have different radius depths based on caliber selected, total volume of gases, or overall mass of material present, with the blast deflection ring including a radius that extends up the inside side wall with an adjustable slope to control gas flow velocity.

Figure 9:
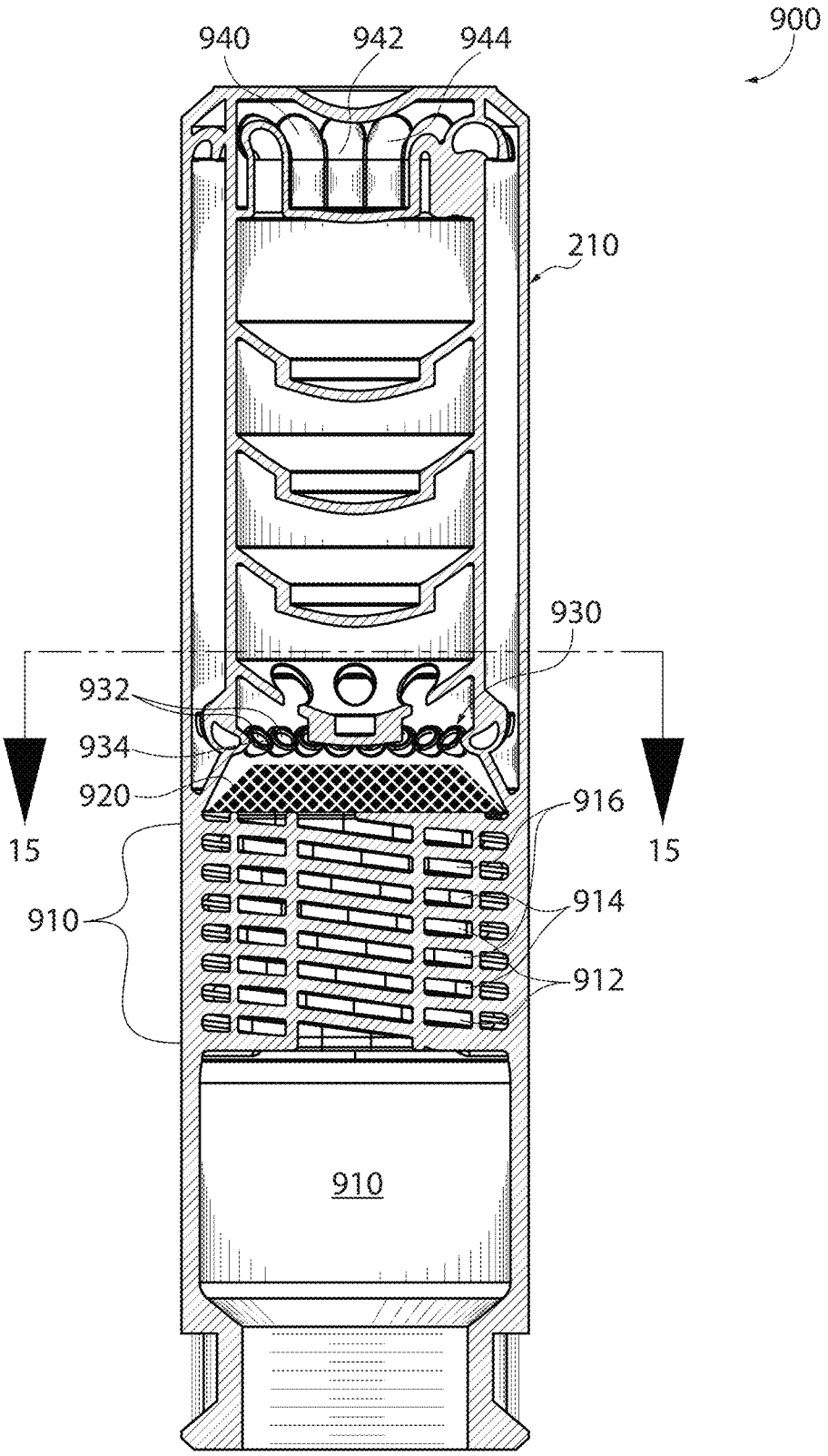
FIG. 9 illustrates a cross-sectional view of the firearm suppressor taken across plane 9-9 (FIG. 7) showing a helical path assembly, a gas recirculation system, and various internal components.

FIG. 9 illustrates a cross-sectional view 900 of a firearm suppressor 210 showing features of the firearm suppressor 210 of FIG. 8 with a slightly different cut plane illustrated as plane 9-9 (FIG. 7). This view shows details that may be previously described but better illustrated, such as the helical geometry of a helical path assembly 910 including 3 separate paths including a first helical path 912, a second helical path 914, and a third helical path 916. The helical path assembly 910 may be supported during additive manufacturing by a lattice 920 (which also serves to fracture flow of gases). Also shown are details of a plurality of injection ports 930, including a first injection port 932 and a second injection port 934. Each of these injection ports 932, 934 of the plurality of injection ports 930 may be individual tubes that are additively manufactured with the entire firearm suppressor. The firearm suppressor 210 may be further provided with a plurality of return tubes 940, e.g., individual return tubes including a first return tube 942 and a second return tube 944. This plurality of return tubes 940 may be circular flowpaths that reverse the flow of gases.

Figure 10:
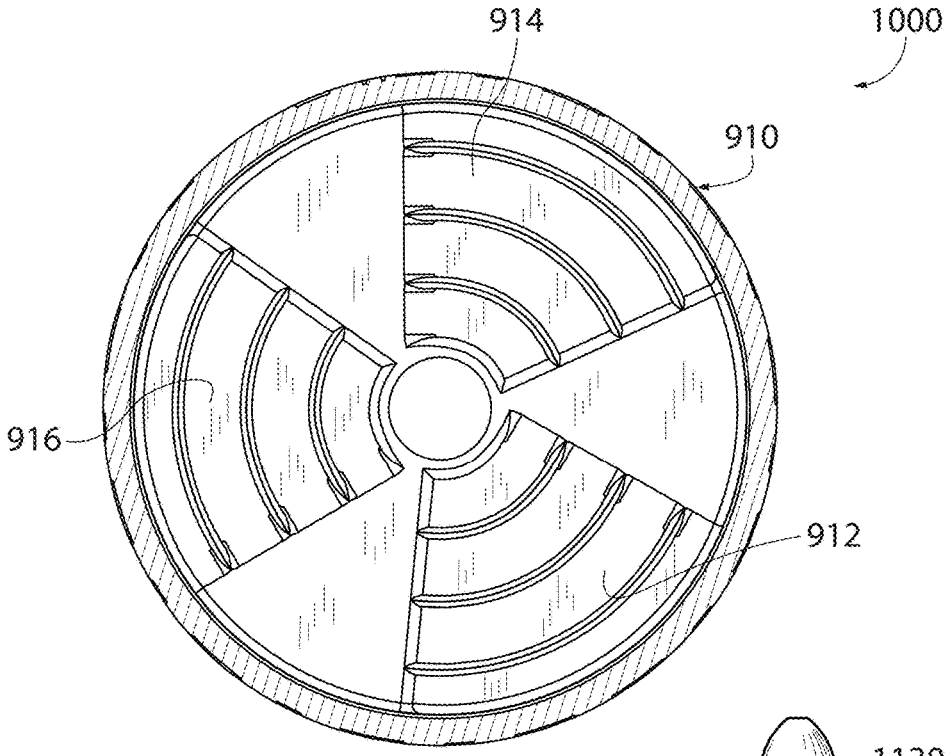
FIG. 10 illustrates a cross-sectional view taken across plane 10-10 (FIG. 8) of the helical path assembly with multiple spiral pathways.

FIG. 10 illustrates a cross-sectional view 1000 of a helical path assembly 910 for a firearm suppressor. The helical path assembly 910 may include a first helical path 912, a second helical path 914, and a third helical path 916 arranged in a coaxial configuration. Each helical path forms a spiral pathway that extends longitudinally through the assembly, with the first helical path 912, second helical path 914, and third helical path 916 positioned to provide separate channels for gas flow management. The first helical path 912 may be configured to direct gases through a helical trajectory around a central axis. The first helical path 912 can feature a curved pathway that reduces gas velocity and enhances sound suppression performance. Additionally, the first helical path 912 may be separated from adjacent pathways by internal walls that maintain distinct gas flow channels throughout the helical path assembly 910. The second helical path 914 may be positioned coaxially relative to the first helical path 912 and can be off-phased to create distinct entrance points for incoming gases. The second helical path 914 can follow a spiral trajectory that parallels the first helical path 912 while maintaining separation through internal wall structures. Moreover, the second helical path 914 may provide an independent channel for gas distribution within the helical path assembly 910. In an illustrative configuration, the third helical path 916 may be arranged coaxially with both the first helical path 912 and the second helical path 914. The third helical path 916 can be off-phased from the other helical paths to provide additional gas flow management capabilities. Consequently, the third helical path 916 may create a third independent spiral pathway that contributes to the overall gas velocity reduction and sound suppression performance of the helical path assembly 910.

With continued reference to FIG. 10, in some configurations, each coil may be divided into smaller pathways and three separate tunnels per coil to facilitate proper bridging during the manufacturing process. In this regard, the first helical path 912 may be subdivided into four sections illustrated as 912*a*, 912*b*, 912*c*, and 912*d*. In another configuration, the helical path assembly may feature varying numbers of openings and different sizes based on the volume of gases received by the caliber fired, with the configuration including multiple openings for gas distribution that can be adjusted according to specific caliber requirements. The helical coil assembly may include a flat face inside the blast chamber, with the number of faces reflecting the number of coils used to create the structure. The helical coil assembly may feature support walls running the length of each coil that serve dual purposes of changing the width of openings to allow 3D printing without additional support materials and generating additional turbulence.

Figure 11:
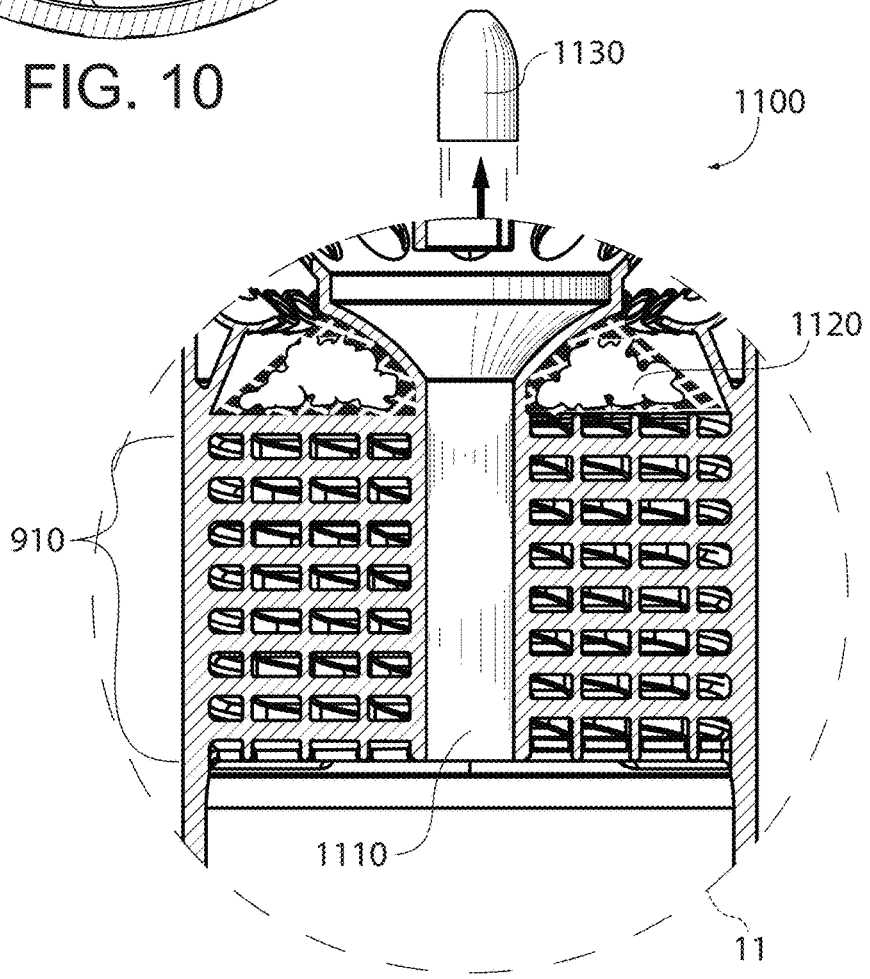
FIG. 11 illustrates an enlarged portion (11 in FIG. 8) of the cross-sectional view showing helical path assembly details.

FIG. 11 illustrates an enlarged portion 11 (FIG. 8) of cross-sectional view 1100 of the helical path assembly 910 for a firearm suppressor. The enlarged portion of the cross-sectional view 1100 may provide a detailed view of the internal structure and gas flow pathways within the helical path assembly 910. The cross-sectional perspective can reveal the internal geometry and spatial relationships between components within the assembly. A bore 1110 may extend through the center of the helical path assembly 910, providing a passage for projectile travel. The bore 1110 can maintain a clear pathway through the helical structure while allowing the spiral gas channels to operate around the central opening. Furthermore, the bore 1110 may be aligned along the longitudinal axis of the suppressor component to ensure proper projectile trajectory. A lattice 1120 may be positioned adjacent to the helical path assembly 910 and can feature an interconnected network of structural members. The lattice 1120 may form a three-dimensional framework that provides structural support for the helical path assembly 910 during additive manufacturing processes. Additionally, the lattice 1120 can increase gas turbulence as gases pass through the suppressor, thereby enhancing sound suppression performance. The lattice 1120 may be configured to support everything at the base of the helical path assembly except the central bore opening, providing comprehensive structural reinforcement during the additive manufacturing process. In an illustrative configuration, a projectile 1130 may be depicted traveling along the bore 1110, illustrating the trajectory path through the suppressor component. The projectile 1130 can demonstrate how ammunition passes through the helical path assembly 910 without interference from the spiral gas channels. Thereafter, the projectile 1130 may continue through the bore 1110 while gases are simultaneously processed through the first helical path 912, second helical path 914, and third helical path 916.

Figure 12:
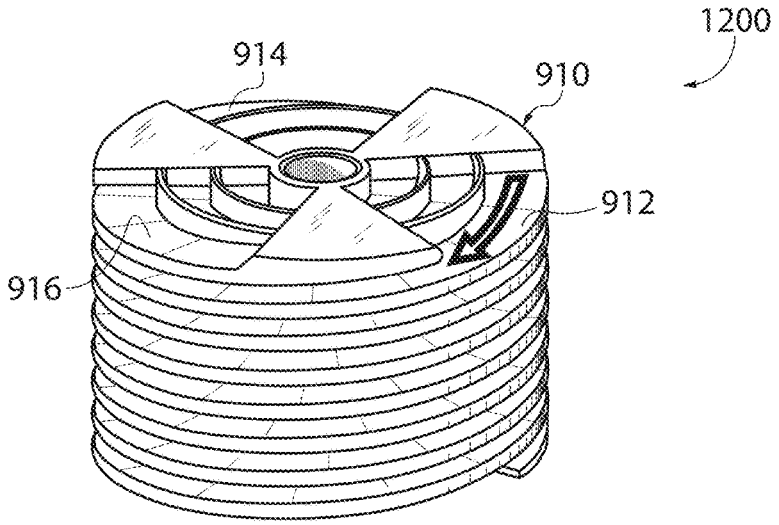
FIG. 12 illustrates a perspective view of a helical path assembly showing a three-dimensional configuration.

FIG. 12 illustrates a perspective view 1200 of the helical path assembly 910 for a firearm suppressor. The perspective view 1200 may demonstrate the three-dimensional spatial relationship between the first helical path 912, the second helical path 914, and the third helical path 916. The perspective view 1200 can reveal how the helical paths are arranged in their coaxial configuration while maintaining their off-phased relationship. The perspective view 1200 may show how the first helical path 912, the second helical path 914, and the third helical path 916 create distinct entrance points for incoming gases. Each helical path can feature a curved pathway that directs gases through a spiral trajectory, with the off-phased arrangement ensuring that gas flow is distributed across multiple channels. Consequently, the perspective view 1200 may illustrate how the helical paths work together to reduce gas velocity and enhance sound suppression.

The perspective view 1200 may also demonstrate the geometry of the helical path assembly 910 to form a comprehensive gas management system within a firearm suppressor. The apparatus may extend from a proximal end configured to attach to a firearm barrel to a distal end, with a housing disposed between these endpoints. The housing may include a plurality of components that work in coordination to extend gas dwell time within the firearm suppressor through controlled gas flow pathways and recirculation mechanisms. Incorporating varied tunnel widths, also known as 'turbulent flow modulation,' may be employed to reduce gas speed and dissipate heat more effectively, with narrower tunnels being essential for printing feasibility, as the printer cannot bridge the gap needed for a single large opening. An inner tube may be formed down the center of the helical path assembly 910. The helical path apparatus may provide enhanced sound suppression through multiple mechanisms, including extended gas pathways, controlled recirculation, and increased gas turbulence. The combination of helical paths, lattice structures, baffle configurations, and recirculation systems may work together to maximize gas dwell time and optimize suppressor performance across various operating conditions.

Figure 13:
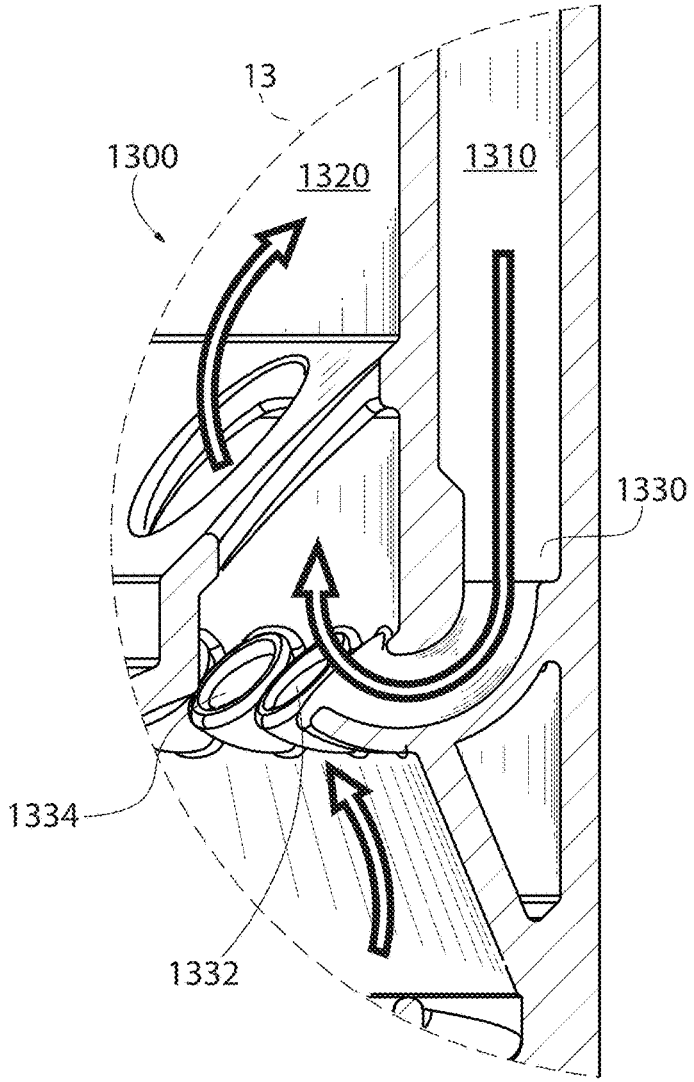
FIG. 13 illustrates an enlarged portion (13 in FIG. 8) of a cross-sectional view showing peripheral and central chambers.

FIG. 13 illustrates an enlarged portion of cross-section view 1300 for a firearm suppressor illustrated as element 13 (FIG. 8). The enlarged portion of cross-section view 1300 may include a peripheral chamber 1310 that can be separated from a central chamber 1320. The peripheral chamber 1310 may be positioned around an outer region of the suppressor assembly and can provide a pathway for gas management within the suppressor structure. The central chamber 1320 may be disposed within an interior region of the suppressor and can be configured to receive gas flow from various internal components.

The peripheral chamber 1310 may be configured to facilitate gas circulation throughout the suppressor assembly. In some cases, the peripheral chamber 1310 can extend longitudinally along a substantial portion of the suppressor length and may provide a conduit for redirected gases. The central chamber 1320 may be positioned concentrically within the peripheral chamber 1310 and can be separated by structural elements that maintain distinct gas flow pathways. Additionally, the central chamber 1320 may receive gases from upstream components and can direct the gases through various baffle configurations.

The enlarged portion of cross-section view 1300 may further include an injection tube 1330, an injection tube 1332, and an injection tube 1334. The injection tube 1330 may be positioned to facilitate gas transfer between chambers and can be configured to direct gas flow in a predetermined direction. The injection tube 1332 may be disposed adjacent to the injection tube 1330 and can provide additional gas flow management capabilities. Moreover, the injection tube 1334 may be arranged to work in conjunction with the injection tube 1330 and the injection tube 1332 to create a comprehensive gas distribution system.

In an illustrative configuration, the injection tube 1330, the injection tube 1332, and the injection tube 1334 may be strategically positioned to optimize gas flow between the peripheral chamber 1310 and the central chamber 1320. The injection tube 1330 may include an inlet portion that can receive gas from the peripheral chamber 1310 and an outlet portion that can release gas into a designated region. Consequently, the injection tube 1332 may be configured with similar inlet and outlet features that can facilitate proper gas circulation. The injection tube 1334 may provide additional gas flow capacity and can be positioned to ensure uniform gas distribution throughout the suppressor assembly.

Figure 14:
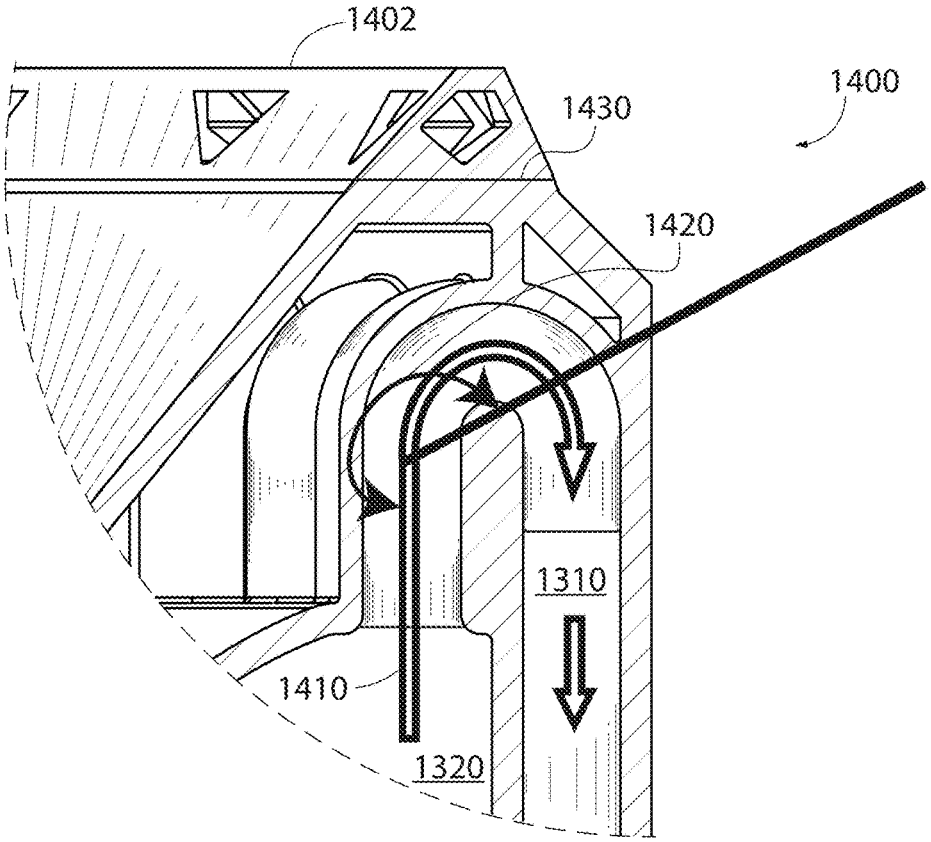
FIG. 14 illustrates an enlarged area (14 in FIG. 8) of cross-sectional view showing gas flow pathways and manufacturing structures.

FIG. 14 illustrates an enlarged area of cross-sectional view 1400 showing the proximal end of a firearm suppressor assembly and associated manufacturing support structures, as illustrated as element 14 (FIG. 8). The enlarged area of cross-sectional view 1400 may include a build raft 1402 that can be positioned at a base portion of the assembly. The build raft 1402 may represent a support structure used during additive manufacturing processes and can provide anchoring for components during fabrication. Additionally, the build raft 1402 may be configured to maintain structural stability during layer-by-layer construction using Direct Metal Laser Sintering or similar additive manufacturing technologies. The enlarged area of cross-sectional view 1400 may further include a forward flowpath 1410 that can be illustrated by directional indicators showing gas trajectory. The forward flowpath 1410 may represent an initial path of gases entering the suppressor from a firearm barrel and can direct gases through internal chambers. The forward flowpath 1410 may be configured to facilitate gas movement from a proximal end toward internal suppressor components. Furthermore, the forward flowpath 1410 can provide a primary route for propellant gases as the gases enter the suppressor assembly.

A diverted angle 1420 may be indicated in the gas flow pattern within the enlarged area of cross-sectional view 1400. The diverted angle 1420 may demonstrate where gases can be redirected from an initial forward trajectory and can show gas transition between chambers. In some cases, the diverted angle 1420 may redirect gases by approximately 180 degrees to facilitate gas recirculation. The diverted angle 1420 may be configured to enhance gas dwell time within the suppressor and can contribute to sound suppression performance by extending the time gases remain within the suppressor structure.

In an illustrative configuration, the enlarged area of cross-sectional view 1400 may include a raft cut line 1430 that can indicate a location where the build raft 1402 may be removed from a finished suppressor component. The raft cut line 1430 may be positioned to facilitate post-processing operations and can provide guidance for separating manufacturing support structures from functional components. Thereafter, the raft cut line 1430 may enable clean removal of the build raft 1402 while preserving the structural integrity of the suppressor assembly. The relationship between the build raft 1402, the forward flowpath 1410, the diverted angle 1420, and the raft cut line 1430 may demonstrate how manufacturing support structures can facilitate additive manufacturing processes while functional gas pathways contribute to suppressor performance.

Figure 15:
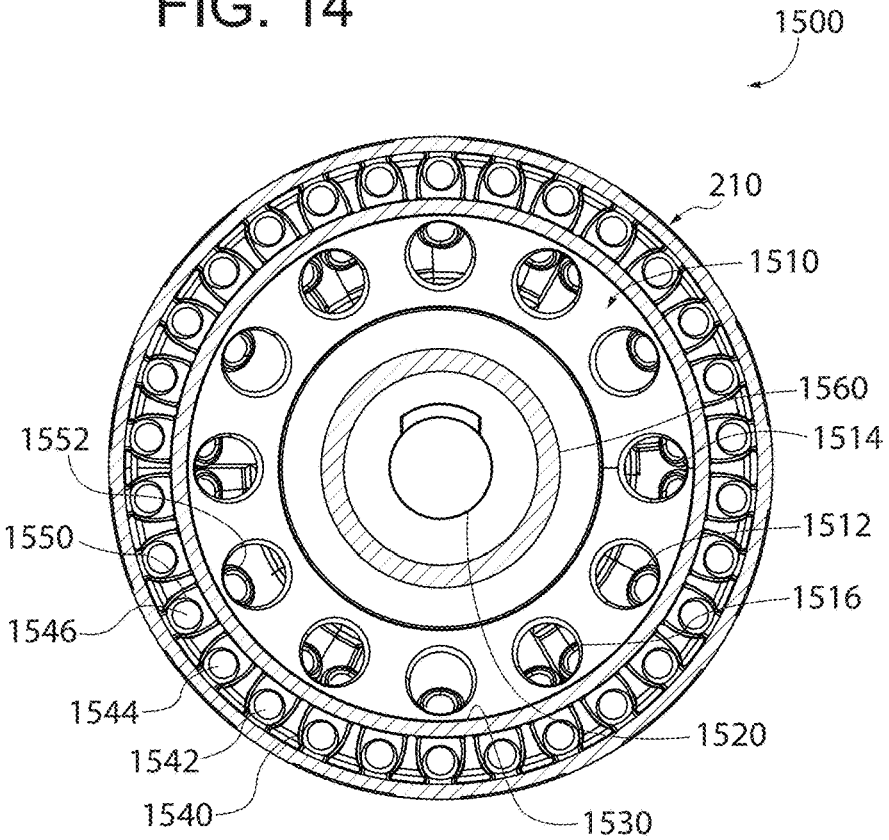
FIG. 15 illustrates a cross-sectional view across plane 15-15 (FIG. 9) of the firearm suppressor showing receiving baffle and injection tubes.

FIG. 15 illustrates a cross-sectional view 1500 taken across plane 15-15 (FIG. 9) of a firearm suppressor 210 showing internal components and gas flow pathways. The cross-sectional view 1500 may expose one arrangement of components within the firearm suppressor 210, including a receiving baffle 1510 positioned near the proximal end of the suppressor assembly. The receiving baffle 1510 may be configured to manage gas flow distribution as gases enter the suppressor system from the blast chamber region. The receiving baffle 1510 may include a plurality of ports 1512 formed through the baffle structure to facilitate controlled gas flow management. The plurality of ports 1512 may be strategically positioned to direct gas flow in predetermined directions within the suppressor assembly and provide a tuned restriction. A first port 1514 and a second port 1516 may be visible among the plurality of ports 1512, demonstrating the distribution of openings through the receiving baffle 1510. The plurality of ports 1512 may be configured to allow gas to flow through the receiving baffle 1510 while providing directional control over the gas movement patterns.

An inner tube 1530 may be disposed within the firearm suppressor 210 and extend longitudinally through the assembly to create chamber separation. The inner tube 1530 may separate the internal volume into distinct chambers, creating a peripheral chamber between the inner tube 1530 and the outer housing of the firearm suppressor 210. A bore 1520 may extend through the center of the assembly, providing a passage for projectiles and gases during firing operations. The bore 1520 may maintain alignment along the longitudinal axis of the suppressor to ensure unobstructed projectile travel.

In an illustrative configuration, a plurality of injection tubes 1540 may be positioned within the firearm suppressor 210 to facilitate gas recirculation between chambers. The plurality of injection tubes 1540 may include a first injection tube 1542, a second injection tube 1544, and a third injection tube 1546 arranged to provide multiple pathways for gas movement. The plurality of injection tubes 1540 may be in fluid communication with the peripheral chamber and configured to convey gas from the peripheral chamber toward the receiving baffle 1510. The first injection tube 1542, the second injection tube 1544, and the third injection tube 1546 may be positioned circumferentially around the suppressor assembly to provide balanced gas distribution.

An inlet 1550 may be visible at the proximal end of the firearm suppressor 210, providing an entry point for gases from the firearm barrel during operation. The inlet 1550 may be configured to receive high-pressure gases and direct them into the suppressor's internal chamber system. An outlet 1552 may be positioned to allow gas to exit the receiving baffle 1510 region after passing through the plurality of ports 1512. The outlet 1552 may facilitate the transition of gases from the receiving baffle 1510 into subsequent suppressor components.

An adjoining intermediary baffle 1560 (also illustrated, for example, as first intermediate baffle 842, FIG. 8) may be positioned downstream from the receiving baffle 1510 within the central chamber to provide additional gas management. The adjoining intermediary baffle 1560 may be configured to direct further and control gas flow as gases progress through the suppressor assembly. The plurality of ports 1512 of the receiving baffle 1510 may be arranged in a pattern configured to direct gas flow radially inward from the peripheral chamber into the central chamber, creating a controlled transition between the chamber systems. This radial inward flow pattern may enhance gas mixing and extend gas dwell time within the suppressor assembly for improved sound suppression performance.

Figure 16:
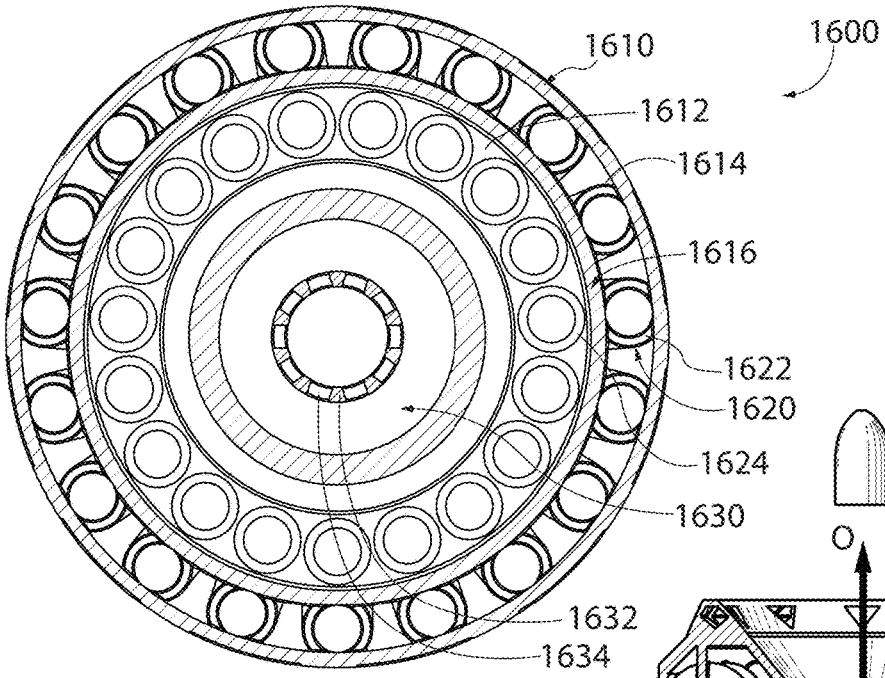
FIG. 16 illustrates a cross-sectional view across plane 16-16 (FIG. 8) of the firearm suppressor showing the terminal baffle assembly.

FIG. 16 illustrates a cross-sectional view 1600 of a firearm suppressor 1610 taken across plane 16-16 (FIG. 8) showing the terminal baffle assembly and gas flow pathways. The cross-sectional view 1600 may reveal the internal structure at the distal end of the firearm suppressor 1610, including a terminal baffle 1630 and associated components. The firearm suppressor 1610 may extend longitudinally and terminate at the distal end, where the terminal baffle 1630 manages gas flow redirection.

The terminal baffle 1630 may be positioned at the distal end of the firearm suppressor 1610 and can include a neck 1632 that extends from a terminal baffle wall 1612. The terminal baffle wall 1612 may form the outer boundary of the terminal baffle 1630 and can provide structural support for gas redirection components. The neck 1632 may extend inwardly from the terminal baffle wall 1612 and can be configured to facilitate gas flow management through the terminal baffle assembly.

A plurality of windows 1634 (also shown, for example, in FIG. 8 as the plurality of windows 856) may be formed in the neck 1632, providing openings through which gases can pass during suppressor operation. The plurality of windows 1634 may be distributed around the circumference of the neck 1632 to facilitate gas flow through the terminal baffle 1630. The plurality of windows 1634 can allow gases to transition between chambers while maintaining controlled flow patterns within the firearm suppressor 1610.

In an illustrative configuration, a plurality of return tubes 1620 may be formed on the terminal baffle 1630 and can be arranged circumferentially around the neck 1632. Each of the plurality of return tubes 1620 may include an inlet 1624 positioned to receive gas from the central chamber and an exit 1622 that releases gas into a periphery chamber 1614. The plurality of return tubes 1620 may be configured to redirect gas flow from the central chamber to the periphery chamber 1614, providing a pathway for gas recirculation within the firearm suppressor 1610.

The inlet 1624 of each return tube may be positioned to capture gases flowing through the central chamber, while the exit 1622 can discharge the redirected gases into the periphery chamber 1614. The plurality of return tubes 1620 may feature curved pathways that change the direction of gas flow by redirecting gases through angular transitions. These curved pathways can facilitate the transition of gases from forward-moving flow to radially outward flow, enabling gas recirculation within the suppressor system.

An inner tube 1616 may be visible in the cross-section view 1600, extending longitudinally through the firearm suppressor 1610. The inner tube 1616 may separate the internal volume into distinct chambers, with the periphery chamber 1614 positioned between the inner tube 1616 and the terminal baffle wall 1612. The periphery chamber 1614 can provide a pathway for redirected gases to flow back toward the proximal end of the firearm suppressor 1610, extending gas dwell time within the suppressor assembly.

Figure 17:
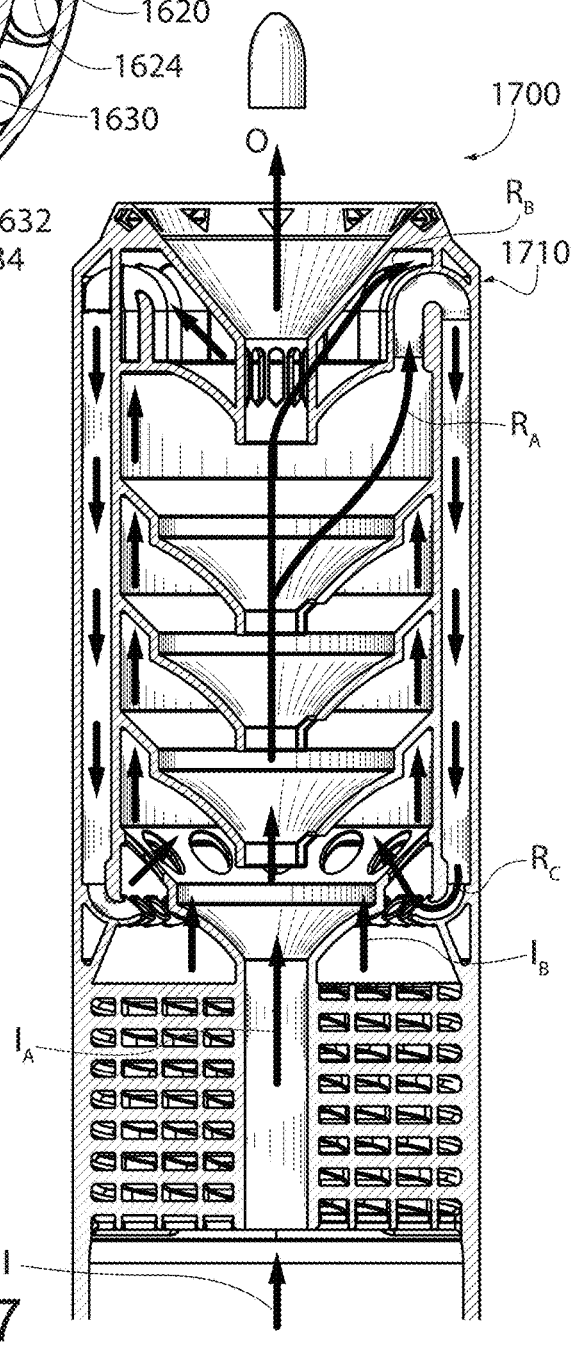
FIG. 17 illustrates a gas flow illustration showing a complete gas recirculation cycle through internal features and chambers.

FIG. 17 illustrates a gas flow illustration 1700 showing a sectional view of a firearm suppressor 1710 with annotated flow paths that demonstrate the complete gas recirculation cycle through the central and peripheral chambers. The gasflow illustration 1700 may include a gas inflow I, a primary inflow $I_A$, a secondary inflow $I_B$, a gas outflow O, a primary return $R_A$, and a secondary return $R_B$. The firearm suppressor 1710 may be configured with features and chambers that facilitate the directional movement of propellant gases through multiple pathways to extend gas dwell time and enhance sound suppression performance.

The gas inflow I represents the initial entry point where propellant gases from the firearm barrel enter the firearm suppressor 1710. The gas inflow "I" may be positioned at the proximal end of the firearm suppressor 1710 and can be configured to receive high-pressure gases expelled during projectile discharge. The gas inflow I may be split into multiple pathways to distribute the incoming gases through different sections of the firearm suppressor 1710, thereby managing gas flow dynamics and reducing pressure concentrations at any single location within the suppressor assembly.

The primary inflow $I_A$ and secondary inflow $I_B$ represent the division of the gas inflow I into separate flow paths within the firearm suppressor 1710. The primary inflow $I_A$ may direct a portion of the incoming gases through a central chamber pathway, while the secondary inflow $I_B$ can channel another portion through alternative routing mechanisms such as helical paths or peripheral chambers. The primary inflow $I_A$ and secondary inflow $I_B$ operate simultaneously, allowing the firearm suppressor 1710 to process the total volume of incoming gases through multiple parallel pathways that enhance gas management efficiency.

In an illustrative configuration, the gas outflow O represents the final exit point where processed gases leave the firearm suppressor 1710 after completing the recirculation cycle. The gas outflow O may be positioned to release gases in a controlled manner that reduces the acoustic signature and muzzle flash. The gas outflow O can be configured to handle the total volume of gases that entered through the gas inflow I, maintaining mass balance within the firearm suppressor 1710 system. The relationship between the gas inflow I and gas outflow O may ensure that the amount of incoming gas equals the amount of outgoing gas, preserving system equilibrium during operation.

The primary return $R_A$ and secondary return $R_B$ represent the recirculation pathways that redirect processed gases back through the firearm suppressor 1710 system. The primary return $R_A$ may convey gases from the central chamber back toward the peripheral chamber, while the secondary return $R_B$ can provide an additional recirculation route that extends gas dwell time within the firearm suppressor 1710. The primary return $R_A$ and secondary return $R_B$ may operate in conjunction to create a comprehensive gas management system that maximizes sound suppression effectiveness through extended gas residence time.

Additionally, the primary return $R_A$ and secondary return $R_B$ may be split from a common source within the firearm suppressor 1710, similar to how the gas inflow I divides into the primary inflow $I_A$ and secondary inflow $I_B$. The primary return $R_A$ can be configured to handle a portion of the recirculating gases, while the secondary return $R_B$ manages the remaining portion through alternative pathways. The primary return $R_A$ and secondary return $R_B$ may converge at specific locations within the firearm suppressor 1710 to facilitate efficient gas mixing and processing before the gases proceed toward the gas outflow O.

Moreover, the gasflow illustration 1700 demonstrates the complete gas recirculation cycle through the central and peripheral chambers of the firearm suppressor 1710. The central chamber may receive gases through the primary inflow $I_A$ and can be configured to process gases through a series of baffles and flow management components. The peripheral chamber may receive gases through the secondary inflow $I_B$ and can provide alternative pathways for gas circulation and cooling. The central and peripheral chambers may be interconnected through the primary return $R_A$ and secondary return $R_B$, creating a closed-loop system that maximizes gas dwell time and enhances suppression performance.

Figure 18:
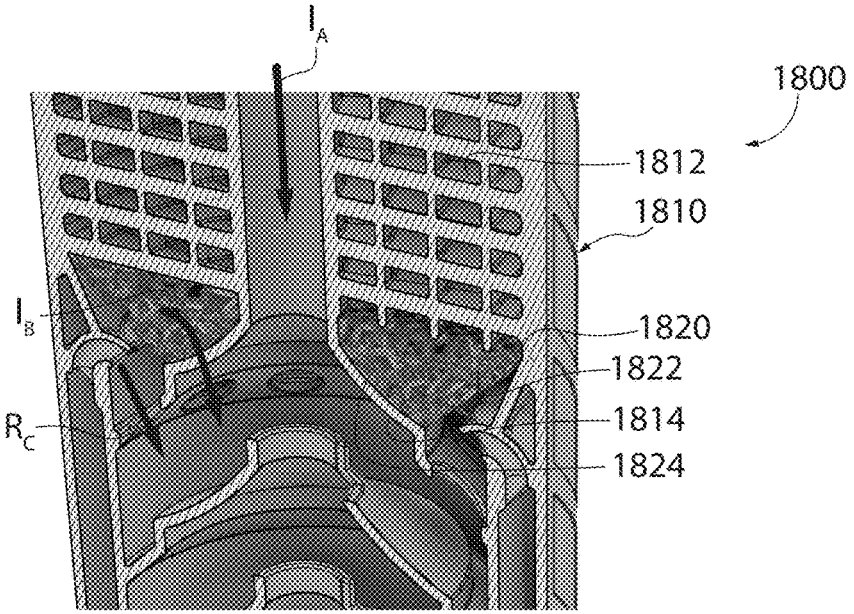
FIG. 18 illustrates a cross-sectional view of a helical path assembly and a receiving baffle configuration, in particular, a support lattice is shown.

FIG. 18 illustrates a cross-sectional view 1800 of a helical assembly and a receiving baffle for a firearm suppressor. The cross-sectional view 1800 may reveal the internal structure and spatial relationship between a suppressor assembly 1810, a helical assembly 1812, and a receiving baffle 1814. The suppressor assembly 1810 may be positioned to contain the helical assembly 1812 and the receiving baffle 1814 within the overall suppressor structure. The helical assembly 1812 may be disposed at a proximal portion of the suppressor assembly 1810 and may include a helical coil 1818 that forms a spiral pathway for gas flow management. The receiving baffle 1814 may be positioned adjacent to the helical assembly 1812 and may be configured to receive gas flow from the helical coil 1818.

The helical coil 1818 may be configured to direct gases through a helical trajectory to reduce velocity and enhance sound suppression within the suppressor assembly 1810. The helical coil 1818 may form one or more spiral pathways that extend longitudinally through the helical assembly 1812, creating channels for gas flow management. The receiving baffle 1814 may feature a conical structure that directs gases through the suppressor system after the gases pass through the helical coil 1818. The cross-sectional view of the helical assembly and receiving baffle may demonstrate how the suppressor assembly 1810, helical assembly 1812, helical coil 1818, and receiving baffle 1814 are integrated to manage gas flow within the firearm suppressor.

The helical assembly 1812 may be supported by a support lattice 1820 that provides structural reinforcement during additive manufacturing processes and increases gas turbulence as gases pass through the suppressor. The support lattice 1820 may include a lattice cap 1822 positioned at an upper portion and a lattice base 1824 positioned at a lower portion. The lattice cap 1822 and the lattice base 1824 may form an interconnected network of structural members that create a three-dimensional framework. The support lattice 1820 may provide both structural support for the helical coil 1818 and enhanced gas turbulence for improved suppressor performance. Additionally, the support lattice 1820 may promote airflow and heat dissipation to prevent overheating within the suppressor assembly 1810.

Figure 19:
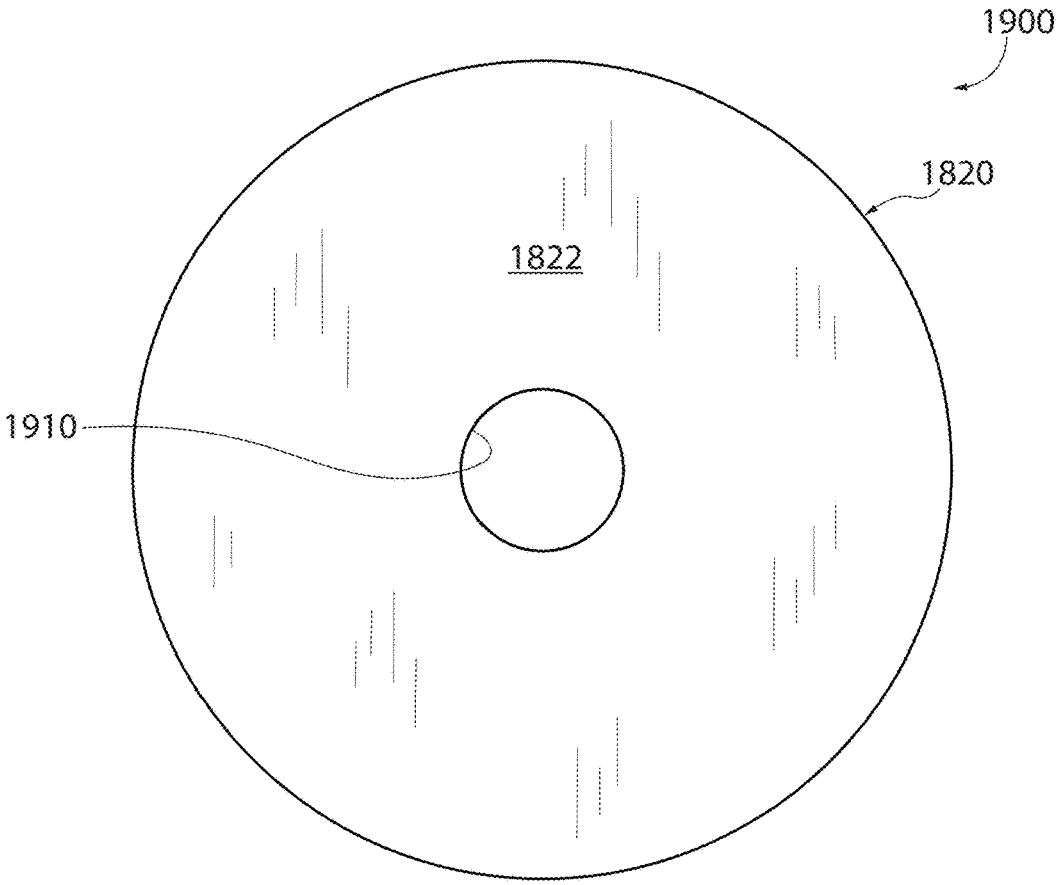
FIG. 19 illustrates a plan view showing a support lattice structure of the firearm suppressor.

In an illustrative configuration, FIG. 19 illustrates a plan view 1900 of the firearm suppressor component showing the internal structure and spatial arrangement of the support lattice 1820. The plan view 1900 may reveal the relationship between the support lattice 1820 and a bore 1910, which are arranged to create a configuration within the suppressor assembly. The support lattice 1820 may be positioned within the plan view 1900 and may be configured to provide structural reinforcement during additive manufacturing processes. The bore 1910 may extend through the center of the assembly, providing a passage for projectile travel through the suppressor component.

The support lattice 1820 may feature an interconnected network of structural members that form a three-dimensional framework within the plan view 1900. The support lattice 1820 may include a series of intersecting struts that create multiple openings through which gases can flow. The lattice cap 1822 may be visible in the plan view 1900 and may form the upper boundary of the support lattice 1820. The bore 1910 may be aligned along the longitudinal axis of the suppressor component and may maintain a clear pathway through the support lattice 1820. The plan view 1900 may demonstrate the spatial relationship between the support lattice 1820 and the bore 1910, illustrating how these components are integrated to manage gas flow and provide structural support within the firearm suppressor assembly.

The support lattice 1820 may be configured to increase gas turbulence as gases pass through the suppressor, thereby enhancing sound suppression performance. The interconnected framework of the support lattice 1820 may create a pattern of openings that facilitate gas flow management within the firearm suppressor assembly. The lattice cap 1822 may provide structural support for adjacent components while allowing gas flow through the openings between the structural members. Moreover, the support lattice 1820 may serve as a safety feature by promoting airflow and heat dissipation, which can prevent overheating during extended firing operations.

Figure 20:
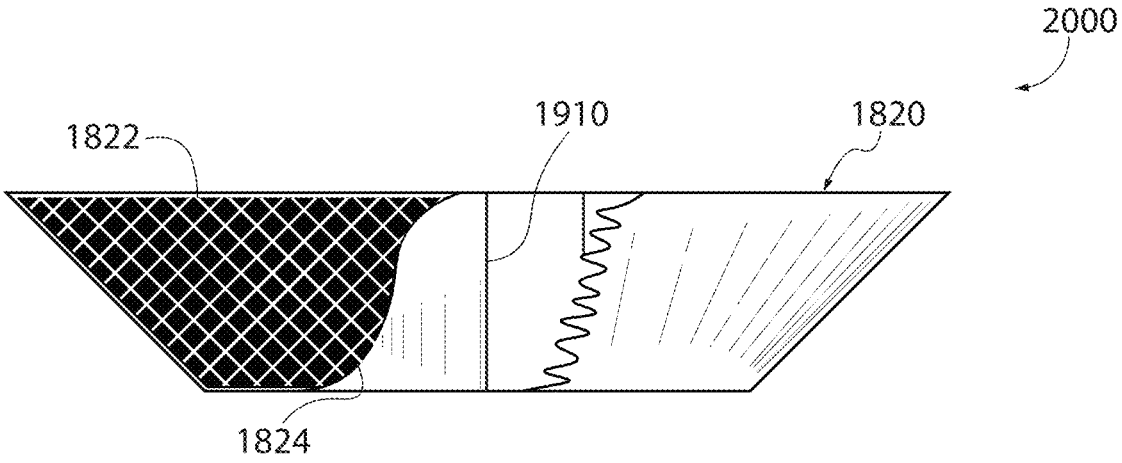
FIG. 20 illustrates a side elevation view of the support lattice of FIG. 19.

In an illustrative configuration, FIG. 20 illustrates a side elevation view 2000 of the support lattice 1820 for the firearm suppressor. The side elevation view 2000 may reveal the internal structure and spatial arrangement of the support lattice 1820, which features the interconnected network of structural members forming the three-dimensional framework. The support lattice 1820 may include the lattice cap 1822 positioned at the upper portion and the lattice base 1824 positioned at the lower portion. The lattice cap 1822 and the lattice base 1824 may be connected by a series of intersecting struts that create multiple openings through which gases can flow.

The bore 1910 may extend through the center of the support lattice 1820, providing a passage for projectile travel through the suppressor component. The bore 1910 may be aligned along the longitudinal axis of the suppressor component and may maintain a clear pathway through the support lattice 1820. The bore 1910 may be surrounded by the structural members of the support lattice 1820, which are arranged to provide structural support while allowing gas flow through the openings between the struts. The side elevation view 2000 may demonstrate the relationship between the lattice cap 1822, the lattice base 1824, and the bore 1910, illustrating how the support lattice 1820 is configured to provide structural reinforcement during additive manufacturing processes.

The support lattice 1820 may be configured to increase gas turbulence as gases pass through the suppressor, thereby contributing to enhanced sound suppression performance. The interconnected framework of the support lattice 1820 may create a pattern of openings that facilitate gas flow management within the firearm suppressor assembly. Consequently, the support lattice 1820 may serve multiple functions, including structural support during manufacturing, gas turbulence enhancement for sound suppression, and heat dissipation for safety purposes. The lattice cap 1822 may form the upper boundary of the support lattice 1820, while the lattice base 1824 may form the lower boundary, creating a comprehensive structural framework that supports the overall suppressor assembly 1810.

Any of the support lattices (e.g., support lattice 822 and support lattice 1820) may be configured as a Voronoi lattice structure that partitions the internal volume into regions defined by seed points, where each cell is equidistant between neighboring seed points. The design parameters include the density of seed points and the thickness of structural beams, which may be adjusted to control cell size, distribution, and mechanical properties, including stiffness, weight reduction, and resilience to damage. The Voronoi lattice may provide enhanced heat dissipation by increasing surface area for thermal transfer and creating tortuous pathways for gas flow that enhance convective heat transfer while increasing gas turbulence for improved sound suppression. The interconnected nature of the Voronoi lattice creates redundant load paths that maintain functionality even when individual beams or vertices experience damage or clogging during additive manufacturing processes. The probabilistic design approach incorporates statistical modeling to predict structural properties across manufacturing variations, ensuring adequate performance characteristics. The Voronoi lattice configuration may be manufactured using Direct Metal Laser Sintering technology and applied to other suppressor components, including the helical assembly 1812, receiving baffle 1814, and terminal baffle 850 for comprehensive structural optimization throughout the suppressor assembly.

Figure 21:
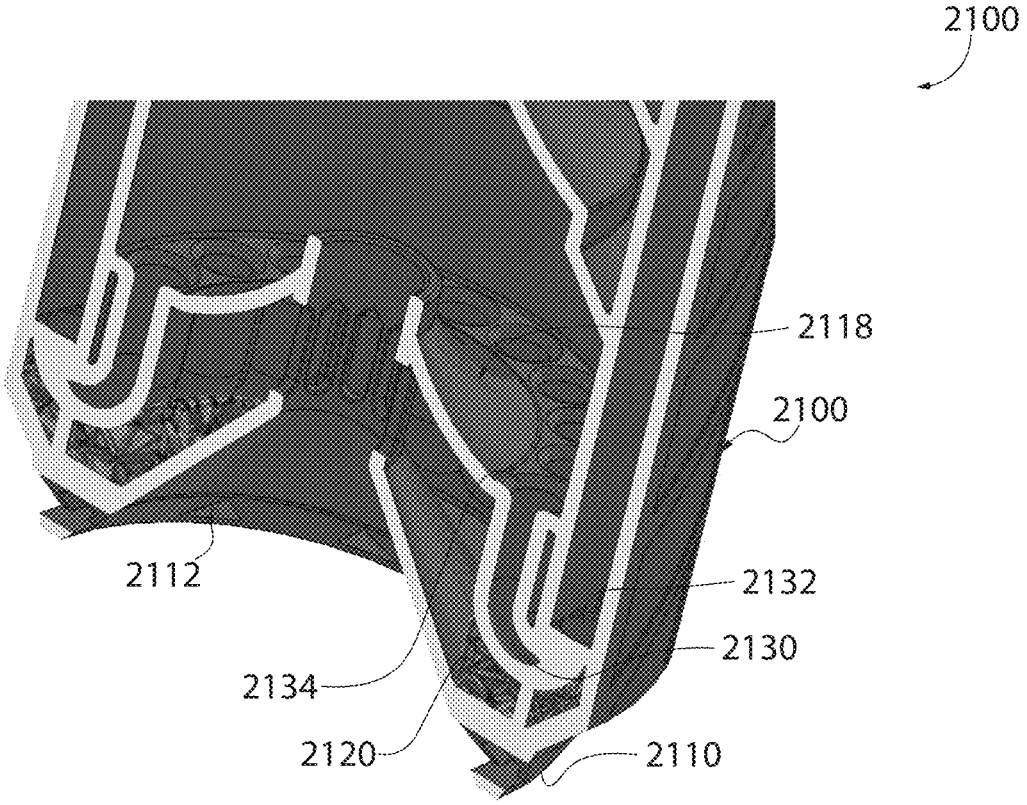
FIG. 21 illustrates a cross-sectional view of a distal end of a firearm suppressor showing a terminal baffle, a support lattice, and a manufacturing support (the manufacturing support may, in one configuration, be removed before installation on a firearm)

FIG. 21 illustrates a cross-sectional view 2100 show a distal end of a firearm suppressor 2102 with manufacturing support structures and functional components positioned at the terminal end of the assembly. The cross-sectional view of distal end 2100 may reveal the internal architecture and spatial relationships between components that facilitate both additive manufacturing processes and operational gas management functionality. The firearm suppressor 2102 may include various elements configured to manage gas flow while accommodating the manufacturing requirements associated with Direct Metal Laser Sintering (DMLS) or similar additive manufacturing technologies.

A build raft 2110 may be positioned at the base of the firearm suppressor 2102 and can serve as a foundational support structure during the additive manufacturing process. The build raft 2110 may provide stability and anchoring for the suppressor components as material layers are deposited during fabrication. Additionally, the build raft 2110 may include structural features that facilitate proper orientation and support of complex internal geometries during the printing process. A plurality of features such as a raft window 2112 may be formed within the build raft 2110 to provide access or clearance for specific manufacturing operations or to reduce material usage while maintaining structural integrity.

A terminal baffle 2118 may be disposed within the firearm suppressor 2102 at the distal end and can be configured to manage gas flow as gases reach the terminal portion of the suppressor assembly. The terminal baffle 2118 may include structural features that redirect gas flow from a central chamber toward peripheral pathways to facilitate gas recirculation within the suppressor system. Moreover, the terminal baffle 2118 may be positioned to interact with other internal components to create the desired gas flow patterns that enhance sound suppression performance.

In an illustrative configuration, a return lattice 2120 may be positioned adjacent to the terminal baffle 2118 and can provide both structural support during manufacturing and functional gas management during operation. The return lattice 2120 may include an interconnected network of structural members that form a three-dimensional framework designed to support complex geometries during the additive manufacturing process. Consequently, the return lattice 2120 may also serve to increase gas turbulence as gases pass through the suppressor, thereby enhancing cooling and sound suppression effectiveness. The return lattice 2120 may be configured with specific geometric patterns (e.g., Voronoi lattice) that optimize both manufacturing feasibility and operational performance.

A plurality of gas flow features, such as a return tube 2130 may be formed on or adjacent to the terminal baffle 2118 and can be configured to redirect gas flow within the firearm suppressor 2102. The return tube 2130 may provide a curved or angled pathway that changes the direction of gas movement to facilitate recirculation of gases through the suppressor system. Furthermore, the return tube 2130 may be positioned to capture gases from one chamber and convey them to another chamber to extend gas dwell time within the suppressor assembly.

An inlet 2132 may be positioned at one end of the return tube 2130 and can be configured to receive gas from a peripheral chamber or other internal volume within the firearm suppressor 2102. The inlet 2132 may be sized and positioned to optimize gas capture and flow management based on the expected gas volumes and pressures encountered during firearm operation. Thereafter, an outlet 2134 may be positioned at the opposite end of the return tube 2130 and can be configured to release gas into a central chamber or other designated volume within the suppressor assembly. The outlet 2134 may be oriented to direct gas flow in a manner that supports the overall gas recirculation strategy of the suppressor system.

Figure 22:
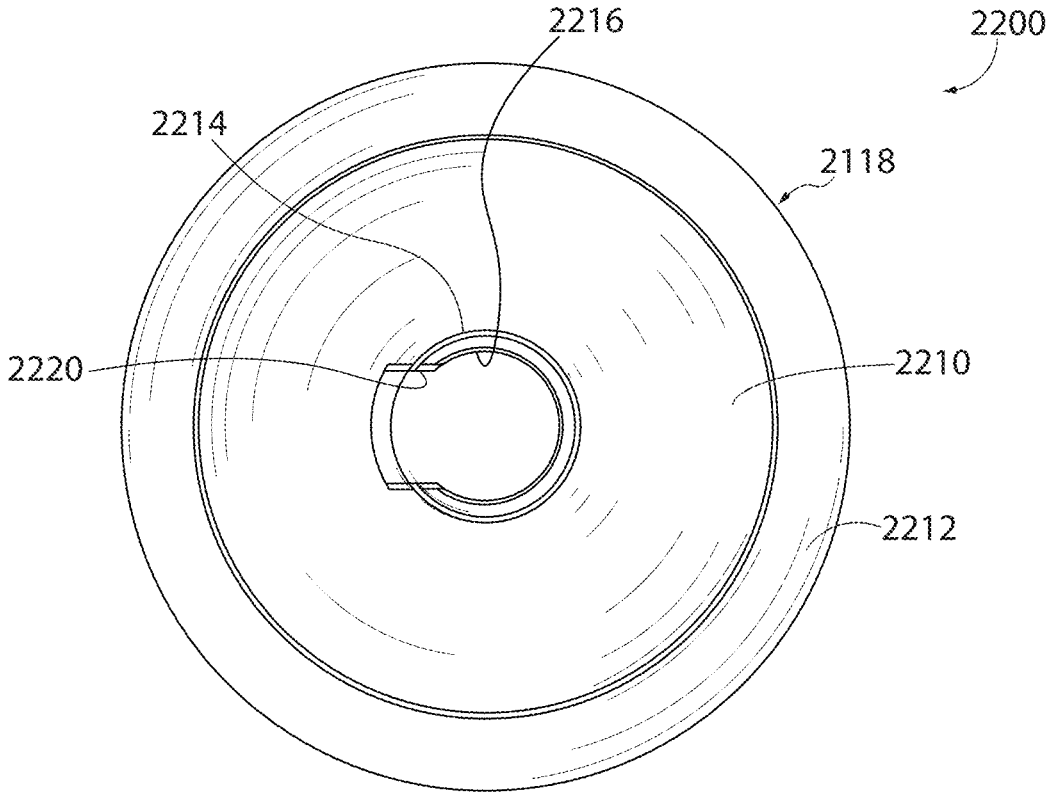
FIG. 22 illustrates a top view of an intermediary baffle with a tuning notch configuration.

FIG. 22 illustrates a top view 2200 of an intermediary baffle 2210 for a firearm suppressor. The intermediary baffle 2210 may include a skirt 2212 that forms an outer perimeter 2218 of the baffle structure. A neck 2214 may be positioned at the center of the intermediary baffle 2210 and extends inwardly from the skirt 2212. The neck 2214 may include a bore 2216 formed through the center, providing a passage for projectile travel through the intermediary baffle 2210. The skirt 2212 may extend radially outward from the neck 2214 and provides a surface for gas interaction within the suppressor. The outer perimeter 2218 may define the boundary of the intermediary baffle 2210 and can be configured to fit within the suppressor housing. The intermediary baffle 2210 may further include a tuning notch 2220 formed in the skirt 2212. The tuning notch 2220 may create an opening that extends from the outer perimeter 2218 toward the neck 2214. The tuning notch 2220 can be configured to modify gas flow characteristics through the intermediary baffle 2210 by providing an alternate pathway for gas movement around the baffle structure. The top view 2200 may demonstrate the spatial relationship between the skirt 2212, neck 2214, bore 2216, outer perimeter 2218, and tuning notch 2220, illustrating the configuration of the intermediary baffle 2210 within the firearm suppressor assembly.

Figure 23:
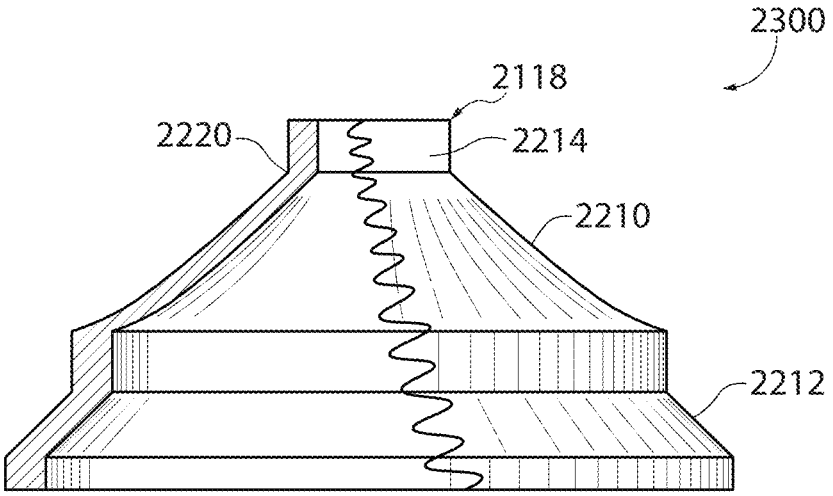
FIG. 23 illustrates a partial breakout side view of the intermediary baffle of FIG. 22 showing internal structure.

FIG. 23 illustrates a partial breakout sideview 2300 of the intermediary baffle 2210, revealing the internal structure and cross-sectional configuration of the baffle components. The partial breakout sideview 2300 may show the same components from the top view 2200 in cross-section, including the skirt 2212, neck 2214, and tuning notch 2220. The cross-sectional view may reveal the conical configuration of the intermediary baffle 2210, where the skirt 2212 forms a conical surface that tapers from the outer perimeter 2218 toward the neck 2214. The neck 2214 may extend from the conical surface and provides a central passage through which projectiles can travel. In an illustrative configuration, the conical configuration of the intermediary baffle 2210 may direct gas flow around the outer perimeter 2218 before the gas passes through the central bore 2216. The tuning notch 2220 may modify gas flow characteristics by creating a controlled opening in the skirt 2212 that allows gas to bypass portions of the conical surface. The tuning notch 2220 can provide fine-tuning capabilities for gas flow management, allowing for optimization of suppressor performance based on specific caliber requirements or operational conditions. The partial breakout sideview 2300 may demonstrate how the tuning notch 2220 extends through the thickness of the skirt 2212, creating a pathway that can influence gas turbulence and flow patterns within the suppressor assembly.

Figure 24:
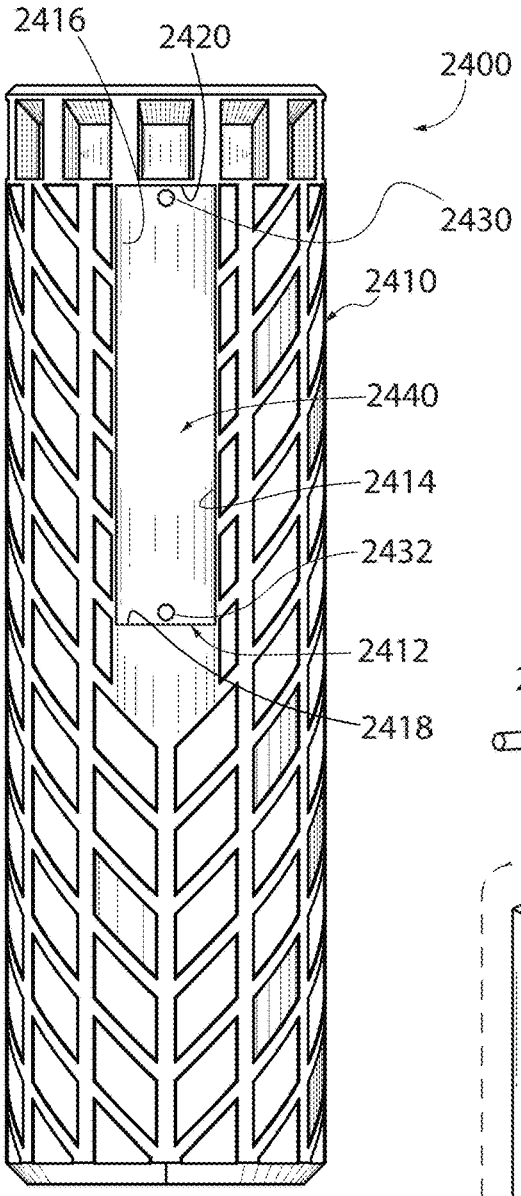
FIG. 24 illustrates a sideview of a firearm suppressor with a modular identification plate system.

FIG. 24 illustrates a sideview 2400 of a suppressor 2410, configured with an identification plate, for firearm applications. Unlike traditional suppressors, which feature stacked, modular components that can be repaired or replaced individually, suppressors manufactured using additive techniques such as Direct Metal Laser Sintering are often made as a single unit. This lack of modularity complicates repairs and warranties, particularly because the suppressor's serial number is permanently affixed to the body. In the event of suppressor damage, there may be no easy way to transfer the serial identification to a new unit, necessitating a complex and legally sensitive replacement process. The suppressor 2410 may extend longitudinally from a first end 2418 to a second end 2420, presenting a cylindrical profile with a textured exterior surface. The suppressor 2410 may include a first side 2414 and a second side 2416, which define opposing surfaces of the cylindrical structure. A plate pocket 2412 may be formed in the exterior surface of the suppressor 2410, configured as a recessed area that extends along a portion of the suppressor 2410 length. The electrode spot welding process may create welds that are easy to drill out without damaging the plate, though the drilling process may destroy the suppressor housing simultaneously. The consistent weld quality provided by electrode spot welding may facilitate clean removal during warranty service operations."

An identification plate 2440 may be positioned within the plate pocket 2412. The identification plate 2440 may be configured to display regulatory markings, serial numbers, manufacturer details, or other identification information for legal compliance. The identification plate 2440 may comprise a plate body having a serial number permanently marked thereon. The plate body may be formed from a material selected from the group consisting of stainless steel, aluminum, titanium, and nickel-chromium superalloy. In some configurations, the plate body may have a thickness of approximately 0.040 inches and can be configured to be bent to match a radius of the suppressor housing while maintaining legibility of the serial number. The identification plate 2440 may be secured to the suppressor 2410 via attachment means. A first attachment 2430 may be visible at one location on the identification plate 2440, and a second attachment 2432 may be visible at another location on the identification plate 2440. The attachment means may comprise one or more welds configured to permanently attach the plate body to the suppressor housing during manufacturing. In some cases, the one or more welds may comprise spot welds positioned at predetermined locations on the plate body. The first attachment 2430 and second attachment 2432 may be positioned to permanently affix the identification plate 2440 to the suppressor 2410 during manufacturing while allowing removal by drilling out (or other manufacturing process) the attachments for warranty repairs.

The attachment means may include an electrode spot welder that provides efficient and precise placement of the plate body with minimal heat distortion. The electrode spot welder may create consistent welds that facilitate subsequent removal by drilling without damaging the plate body. In some cases, traditional welding methods may be employed when electrode spot welding equipment is not available, though such methods may introduce additional heat into the attachment process. In some configurations, the method may include affixing the plate body directly to an exterior surface of the suppressor housing without a recessed slot. The plate body may be bent to match the suppressor housing radius and tacked into place with spot welds, creating a slight protrusion while maintaining legibility of the serial number and other markings. The attachment means may comprise an electrode spot welder configured to create the one or more welds. The electrode spot welder may provide precision and efficiency in attaching the plate body to the suppressor housing, minimizing heat-affected zones and ensuring quicker production compared to traditional welding methods. In some configurations, traditional welding methods may be used as alternatives, though such methods may be less efficient and may introduce excess heat into the attachment process.

In an illustrative configuration, the plate body may comprise a surface configured to receive laser engraving and witness marks configured to indicate alignment positions for the one or more welds. The suppressor housing may comprise a recessed slot configured to receive the plate body such that the plate body sits flush with an exterior surface of the suppressor housing. Additionally, the identification plate may include a flange that allows the identification plate to be slid into the rear of the outer tube and held in place during assembly. The identification plate 2440 can be either flat or curved to match the geometry of the suppressor housing, with flat being preferred for manufacturing ease. The attachment means may comprise an electrode spot welder configured to create the one or more welds. The electrode spot welder may provide precision and efficiency in attaching the plate body to the suppressor housing, minimizing heat-affected zones and ensuring quicker production compared to traditional welding methods. In some configurations, traditional welding methods may be used as alternatives, though such methods may be less efficient and may introduce excess heat into the attachment process.

In some configurations, the suppressor housing may be configured without a recessed slot, and the plate body may be affixed directly to an exterior surface of the suppressor housing. In such configurations, the plate body may be bent to match a radius of the suppressor housing and tacked into place with the one or more welds, creating a slight protrusion on the outside surface while maintaining legal compliance provided the engraved markings remain legible. The plate body may be bent to match the radius of the suppressor housing, provided that the engraved legal markings and serial number remain intact and legible after bending. The specific location of the one or more welds may vary, with the primary requirement being that the plate body must be removable for warranty repairs by drilling out the welds without damaging the plate body. The plate body may be manufactured from materials suitable for laser cutting and laser engraving. The thickness of approximately 0.040 inches may be adjusted based on specific application requirements, as this dimension is not critical to the functionality of the serial identification plate system. The witness marks may be located at various points on the plate body to provide flexibility in attachment positioning during the welding process.

Figure 25:
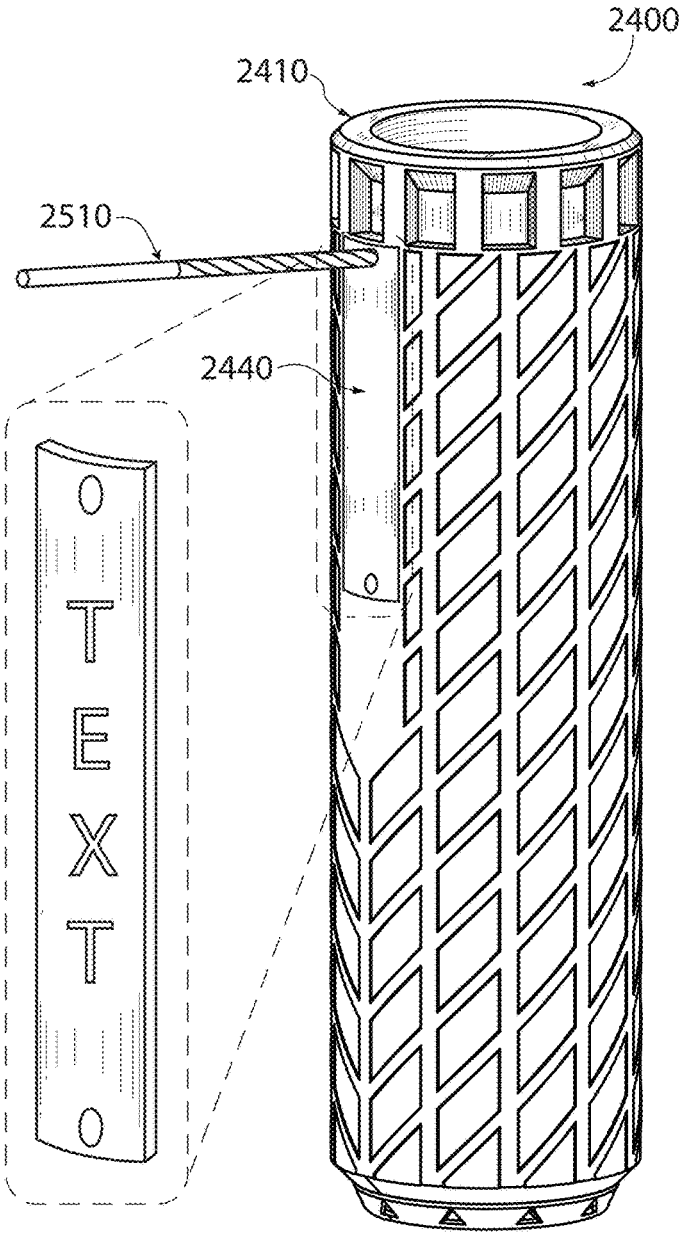
FIG. 25 illustrates a perspective view of the firearm suppressor of FIG. 24, showing the identification plate removal process.

FIG. 25 illustrates a perspective view 2500 of the suppressor 2410 showing the removal process of the identification plate 2440. The suppressor 2410 may extend longitudinally and feature a cylindrical housing with a textured exterior surface. The identification plate 2440 may be positioned on the exterior surface of the suppressor 2410 and display regulatory markings, serial numbers, or manufacturer details for legal compliance.

A drill bit 2510 may be shown positioned adjacent to the identification plate 2440, illustrating the method for removing the identification plate 2440 from the suppressor 2410.

The drill bit 2510 may be configured to drill out spot welds that secure the identification plate 2440 to the suppressor 2410 during manufacturing. The perspective view 2500 may demonstrate the process by which the identification plate 2440 can be detached from the suppressor 2410 for warranty repairs by drilling out the attachment welds. The one or more welds may be removed to detach the plate body from the suppressor housing for warranty repairs. The removal process may include using a drill bit having a diameter of approximately 3/32 inches to drill out the spot welds. The drill bit size may be selected to effectively remove the weld material while minimizing the risk of damage to the plate body or the serial number markings thereon. The electrode spot welding process may facilitate clean removal by creating consistent weld sizes that can be reliably drilled out during warranty service operations. Consequently, the suppressor 2410 may maintain structural integrity during the removal process, allowing the identification plate 2440 to be transferred to a replacement suppressor housing without complex regulatory procedures. The drill bit 2510 may provide the means to remove the permanent attachment while preserving the identification plate 2440 for reuse on a replacement component. The plate body may be transferable to a replacement suppressor housing, enabling manufacturers to streamline warranty and repair processes while maintaining legal requirements for serialized components. Conventional firearm suppressors manufactured using additive techniques present challenges when damaged, as the serial number is permanently affixed to the body, making warranty repairs complex and legally sensitive. A method for providing a serial identification plate system addresses these challenges by creating a transferable identification system that maintains regulatory compliance while enabling efficient warranty service.

The method may include providing a suppressor housing configured to accommodate a removable identification system. The suppressor housing can be manufactured using various techniques including Direct Metal Laser Sintering (DMLS), traditional machining, or other manufacturing processes. In some configurations, the suppressor housing may include a recessed slot configured to receive a plate body such that the plate body sits flush with an exterior surface of the suppressor housing. The recessed slot can be formed during the initial manufacturing process or machined after fabrication to accommodate the identification plate dimensions.

The method may further include forming a removable serial identification plate that serves as the primary identification component for regulatory compliance. The removable serial identification plate may include a plate body having a serial number permanently marked thereon through various marking processes. The plate body can be formed from a material selected from the group consisting of stainless steel, aluminum, titanium, and nickel-chromium superalloy, depending on the specific application requirements and environmental conditions the suppressor will encounter. In some cases, the plate body has a thickness of approximately 0.040 inches and is configured to be bent to match a radius of the suppressor housing while maintaining legibility of the serial number.

In an illustrative configuration, the plate body may include a surface configured to receive laser engraving for the permanent marking of identification information. The laser engraving process can create precise, durable markings that remain legible throughout the operational life of the suppressor. Additionally, the plate body may include witness marks configured to indicate alignment positions for subsequent attachment processes. The witness marks can be formed during the initial fabrication of the plate body and serve as reference points for consistent positioning during assembly. The method may include implementing attachment means for securing the plate body to the suppressor housing during the manufacturing process. The attachment means may include one or more welds configured to permanently attach the plate body to the suppressor housing during manufacturing. In some configurations, the one or more welds comprise spot welds positioned at predetermined locations on the plate body. The spot welds can be applied using electrode spot welding equipment, which provides precise control over weld placement and minimizes heat-affected zones in the surrounding material.

The welding process can be performed at specific locations identified by the witness marks on the plate body. The predetermined locations for the spot welds may be selected to provide adequate attachment strength while allowing for subsequent removal when necessary. The welding parameters, including current, time, and pressure, can be optimized for the specific materials used in both the plate body and suppressor housing to ensure consistent weld quality. In an illustrative configuration, the method may include establishing procedures for warranty repair situations where the plate body must be transferred to a replacement suppressor housing. The one or more welds may be removed to detach the plate body from the suppressor housing for warranty repairs through mechanical removal processes. The removal process can involve drilling out the spot welds using appropriately sized drill bits that remove the weld material without damaging the plate body or compromising the legibility of the serial number markings.

The method may further include transferring the plate body to a replacement suppressor housing following the removal process. The plate body is transferable to a replacement suppressor housing through the same attachment process used during initial manufacturing. The replacement suppressor housing can be prepared with appropriate surface preparation and positioning features to receive the transferred plate body. The witness marks on the plate body can be used to ensure proper alignment during the reattachment process, maintaining consistency with the original installation. The transfer process may include cleaning and inspection of the plate body to ensure the serial number and other identification markings remain legible and undamaged. Surface preparation of the replacement suppressor housing can include cleaning and, if necessary, modification of the recessed slot or attachment area to accommodate the transferred plate body. The reattachment process can utilize the same welding parameters and techniques used during initial manufacturing to ensure equivalent attachment strength and durability.

Figure 26:
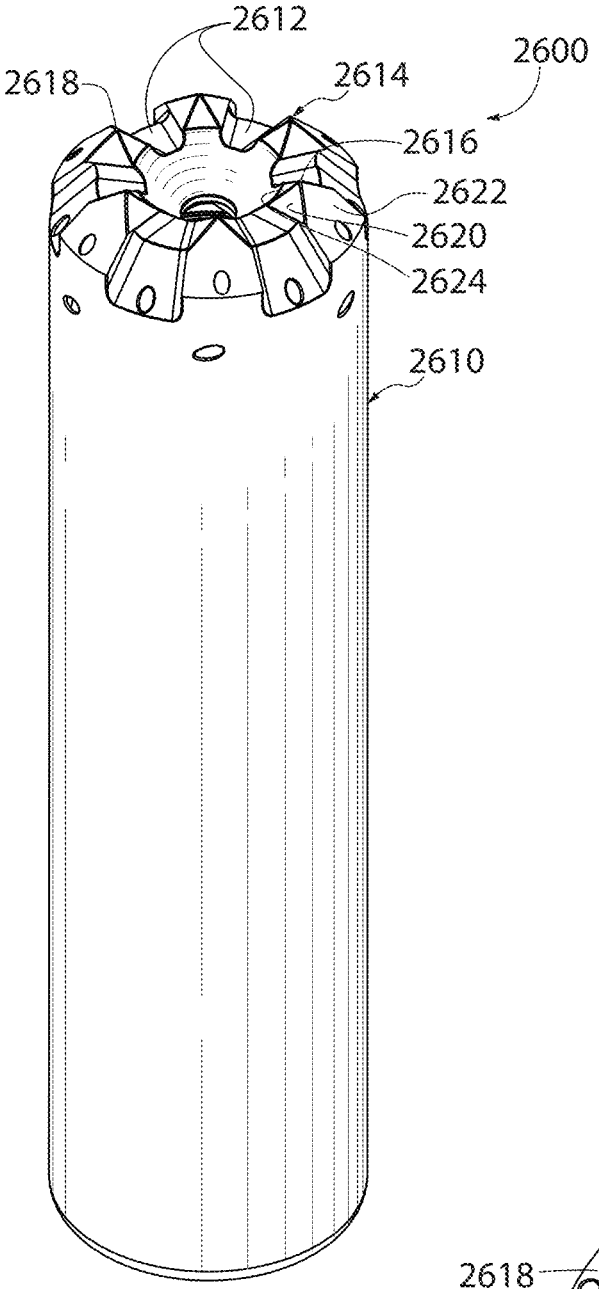
FIG. 26 illustrates a perspective view of a firearm suppressor with integrated glass-breaking features.

FIG. 26 illustrates a perspective view 2600 of a suppressor body 2610 showing a distal end 2612 with integrated glass-breaking features. The suppressor body 2610 may extend longitudinally and terminate at the distal end 2612, which forms a front cap of the suppressor assembly. A plurality of glass breakers 2614 may be integrally formed with the distal end 2612 and arranged in a predetermined pattern around a front surface. The plurality of glass breakers 2614 may include a first glass breaker 2616 and a second glass breaker 2618, which can be positioned at different locations around a circumference of the distal end 2612. Each glass breaker may extend outwardly from the front surface of the distal end 2612 to provide a protruding structure configured for glass penetration.

The first glass breaker 2616 may include a first ramped face 2620 and a second ramped face 2622. The first ramped face 2620 and the second ramped face 2622 can converge to form an edge or point that extends from the distal end 2612. A third ramped face 2624 may be visible on the second glass breaker 2618, demonstrating a multi-faceted geometry of the glass breakers. The ramped faces 2620, 2622, 2624 can be angled to create sharp edges that facilitate glass breaking upon impact. The perspective view 2600 may demonstrate a spatial arrangement of the plurality of glass breakers 2614 on the distal end 2612, illustrating how the glass breakers are distributed around the front surface of the suppressor body 2610.

The suppressor body 2610 may maintain a cylindrical profile with the plurality of glass breakers 2614 projecting from the distal end 2612 to provide auxiliary breaching capability without interfering with a central projectile exit aperture. In an illustrative configuration, the plurality of glass breakers 2614 can be manufactured as integral components of the front cap using Direct Metal Laser Sintering technology. The glass breakers may be formed from materials selected from stainless steel, titanium, and nickel-chromium superalloy to provide durability and resistance to wear. Additionally, the glass breakers can be heat-treated to enhance hardness and may include both flat and serrated edges for maximum penetration efficiency across different glass surfaces.

Figure 27:
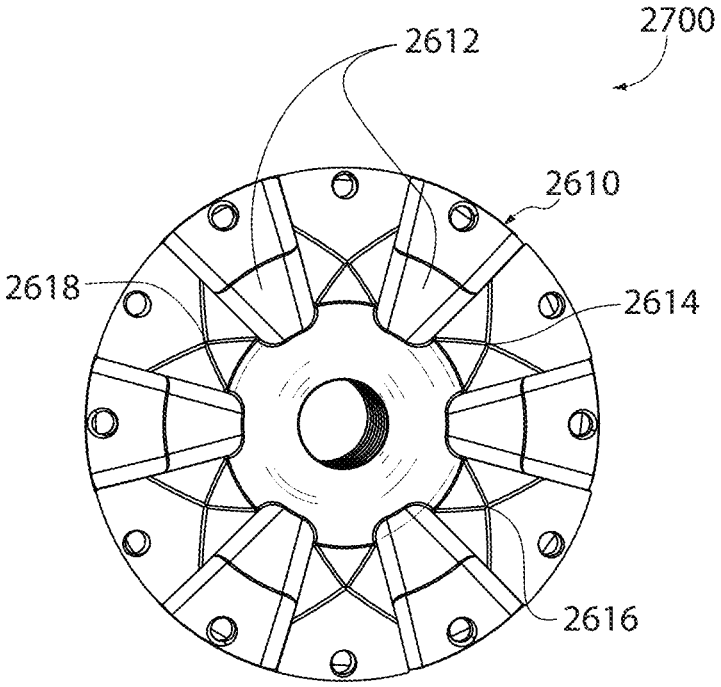
FIG. 27 illustrates a top view of the firearm suppressor of FIG. 26 showing a glass breaker feature.

FIG. 27 illustrates a top view 2700 of the suppressor body 2610 showing the distal end 2612 with integrated glass-breaking features. The distal end 2612 may form the front cap of the suppressor assembly and can be viewed from a perspective looking directly at the front surface. The plurality of glass breakers 2614 may be integrally formed with the distal end 2612 and arranged in the predetermined pattern around the front surface. The plurality of glass breakers 2614 may include the first glass breaker 2616 and the second glass breaker 2618, which can be positioned at different locations around the circumference of the distal end 2612.

The top view 2700 may demonstrate a spatial arrangement and distribution of the plurality of glass breakers 2614 on the distal end 2612. The glass breakers can be positioned in a symmetrical pattern that provides multiple contact points for effective glass-breaking capability. The predetermined pattern may include an octagonal arrangement of the plurality of glass breakers 2614 around a projectile exit aperture. A central aperture may be visible at a center of the distal end 2612, providing a passage for projectile exit during firearm operation. The suppressor body 2610 may maintain a circular profile at the distal end 2612, with the plurality of glass breakers 2614 projecting from the front surface.

The arrangement of the first glass breaker 2616 and second glass breaker 2618, along with other glass breakers in the plurality of glass breakers 2614, may create a pattern that facilitates glass penetration upon impact while maintaining the structural integrity of the distal end 2612. In an illustrative configuration, the plurality of glass breakers 2614 can extend approximately 0.25 inches from the front surface of the front cap. The glass breakers may be configured to provide glass-breaking capability without compromising suppressor performance during firing operations. Moreover, the glass breakers can be configured to break glass without affecting sound suppression characteristics or projectile trajectory through the suppressor assembly.

A method for breaking glass using a firearm suppressor may provide auxiliary breaching capability while maintaining suppressor functionality during standard firing operations. The method may address situations where tactical operators, law enforcement personnel, or emergency responders require rapid glass penetration without compromising the suppressor's primary sound reduction capabilities.

The method may include providing a suppressor housing having a proximal end configured for attachment to a firearm barrel and a distal end. The suppressor housing may extend longitudinally between the proximal end and the distal end, forming a cylindrical structure that houses internal sound suppression components. The proximal end may include threading or other attachment mechanisms that facilitate secure mounting to a firearm barrel, while the distal end may provide an exit point for projectiles during firing operations.

The method may further include disposing a front cap at the distal end of the suppressor housing. The front cap may form the terminal structure of the suppressor assembly and may be configured to provide both projectile exit functionality and auxiliary breaching capability. The front cap may be permanently attached to the suppressor housing through welding, threading, or integral manufacturing processes that ensure structural integrity during both firing operations and glass-breaking applications. In an illustrative configuration, the front cap may include a projectile exit aperture positioned at the center of the front cap structure. The projectile exit aperture may provide a clear pathway for projectiles to exit the suppressor without interference from the glass-breaking features. The aperture may be sized appropriately for the intended caliber and may maintain alignment with the suppressor's internal bore to ensure accurate projectile trajectory. The front cap may additionally include a plurality of spikes integrally formed with the front cap and arranged in a predetermined pattern around the projectile exit aperture. The plurality of spikes may extend outwardly from a front surface of the front cap, creating protruding structures that concentrate force during glass contact. The spikes may be configured to provide glass-breaking capability through their geometric design and material properties, enabling effective glass penetration upon impact.

The spikes may be manufactured as integral components of the front cap, ensuring structural continuity and eliminating potential failure points that could occur with separately attached components. The integral manufacturing approach may provide enhanced durability and reliability during repeated glass-breaking operations while maintaining the structural integrity necessary for suppressor functionality.

In an illustrative configuration, the method may include contacting glass with the plurality of spikes to break the glass. The contact process may involve applying the front cap against a glass surface such that the plurality of spikes make simultaneous contact with the glass. The concentrated force applied through the spike tips may create stress concentrations in the glass material, leading to crack initiation and propagation that results in glass failure. The spikes may extend approximately 0.25 inches from the front surface of the front cap, providing sufficient projection to penetrate glass surfaces while maintaining manageable overall suppressor dimensions effectively. The extension length may be optimized to balance glass-breaking effectiveness with practical considerations such as storage, handling, and integration with firearm systems.

The predetermined pattern may include an octagonal arrangement of the spikes around the projectile exit aperture. The octagonal arrangement may provide multiple contact points distributed around the central aperture, creating a balanced force distribution that enhances glass-breaking effectiveness. The symmetrical arrangement may ensure consistent performance regardless of the orientation of the suppressor relative to the glass surface during contact. In an illustrative configuration, the spikes may be formed from a material selected from the group consisting of stainless steel, titanium, and nickel-chromium superalloy. These materials may provide the hardness and durability necessary for effective glass breaking while maintaining compatibility with the high-temperature and high-pressure environment of suppressor operation. The material selection may be coordinated with the overall suppressor construction to ensure thermal expansion compatibility and structural integrity.

The front cap and the spikes may be manufactured using Direct Metal Laser Sintering technology, enabling the creation of complex geometries and integral spike structures that would be difficult or impossible to achieve through traditional manufacturing methods. The additive manufacturing approach may allow for precise control of spike geometry, surface finish, and material properties while maintaining the structural continuity between the front cap and the integrated spikes. The spikes may be configured to break glass without compromising suppressor performance during firing operations. The spike design and positioning may ensure that the glass-breaking features do not interfere with gas flow patterns, sound suppression mechanisms, or projectile trajectory. The integration of auxiliary functionality may be achieved while preserving the suppressor's primary performance characteristics, providing operators with a multi-functional tool that serves both sound suppression and breaching applications.

Figure 28:
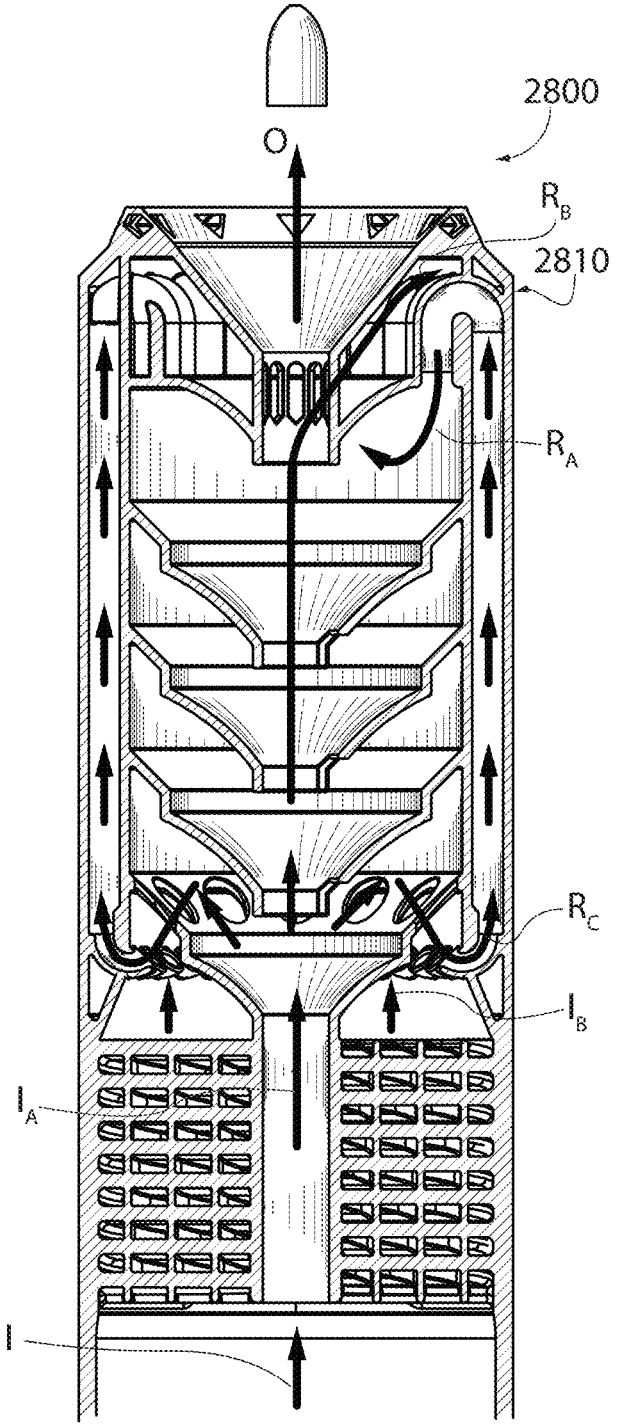
FIG. 28 illustrates a cross-sectional view of a firearm suppressor with a gas recirculation system.

FIG. 28 shows a cross-sectional view 2800 of a firearm suppressor 2810 provided with a recirculation flow path that is reversed. In reality, the event of firing a projectile is so fast that the actual flow of gasses is theorized and may not be known. To be clear, the gasses may flow in the circumferential chamber towards the distal end. Or, there may be some flow 'forward' and some 'backwards.' This figure shows flow arrows making it clear that the flow might be reversed.

In an illustrative configuration, the blast chamber spacer may include holes that run vertically through notches designed to create turbulence and slow down entering gases. The holes may be strategically positioned to maximize gas interaction and enhance the overall suppression performance. The vertical orientation of the holes allows gases to pass through while creating additional turbulence patterns that contribute to velocity reduction and heat dissipation.

The flange attachment system may provide multiple securing options for the tube housing assembly. The flange can be either welded or threaded onto the inner tube to secure the tube housing, depending on manufacturing requirements and performance specifications. Welded attachment may provide a permanent connection with enhanced structural integrity, while threaded attachment may allow for disassembly and maintenance access. The selection between welding and threading may be determined by factors including caliber requirements, pressure specifications, and serviceability considerations.

Additionally, the pinch plate nut design may incorporate specialized tool requirements to prevent inadvertent component loosening. The pinch plate nut design uses rectangular slots instead of hexagonal configurations to require separate tools and prevent accidental loosening of the male-threaded fastener. The rectangular slot pattern may be distributed around the circumference of the pinch plate nut to provide secure engagement with specialized tools. This design approach may reduce the likelihood of user error during suppressor operation and maintenance procedures.

In an illustrative configuration, the barrel adapter system may be enhanced through alternative attachment mechanisms. The barrel adapter design could be improved by utilizing a centrally located tube with a spring-loaded button, switch, or flip-up tab to eliminate the need for multiple components. The spring-loaded mechanism may provide quick-disconnect functionality while maintaining secure attachment to the firearm barrel. The centrally located tube may house the spring mechanism and provide structural support for the attachment system. The button, switch, or flip-up tab may serve as the user interface for engaging and disengaging the attachment mechanism.

The suppressor system may be configured for compatibility with multiple caliber specifications. The suppressor can be designed for different calibers, including 22LR and 5.56, with corresponding changes to bore diameter and overall dimensions. The bore diameter may be adjusted to accommodate specific projectile dimensions while maintaining appropriate clearance tolerances. Overall suppressor dimensions, including length, diameter, and internal chamber volumes, may be scaled according to the gas volume and pressure characteristics of different calibers. The baffle spacing, port sizing, and gas flow pathways may be optimized for each caliber specification.

Moreover, the gas tube configuration may incorporate various geometric shapes to optimize gas flow dynamics. The gas tubes can vary in shape, including elliptical, helical, or polygonal shapes to encourage unique gas flow dynamics. Elliptical gas tubes may provide enhanced flow characteristics with reduced pressure drop compared to circular cross-sections. Helical gas tubes may impart rotational motion to the gas flow, creating additional turbulence and mixing effects. Polygonal gas tubes may create specific flow patterns that enhance heat transfer and velocity reduction.

In an illustrative configuration, alternative baffle designs may be implemented to enhance suppression performance. Alternative baffle configurations include stepped or rifled cones to enhance gas turbulence and reduce muzzle flash. Stepped cone baffles may provide multiple expansion chambers within a single baffle element, creating progressive pressure reduction stages. Rifled cone baffles may incorporate helical grooves or channels that impart rotational motion to the gas flow, enhancing mixing and turbulence generation. The stepped and rifled configurations may be combined with traditional cone designs to create hybrid baffle systems.

The outer tube surface may incorporate weight reduction and thermal management features. Outer tube engravings may be implemented for weight reduction and heat dissipation purposes. The engraving patterns may remove material from non-structural areas while maintaining the tube's pressure-bearing capacity. The surface area increase created by the engraving patterns may enhance convective heat transfer to the surrounding environment. The engraving depth and pattern density may be optimized to balance weight reduction with structural integrity requirements.

Consequently, the lateral vent system may accommodate various opening configurations to optimize gas discharge characteristics. Lateral vent configurations may include different opening types such as slotted openings, angled openings, or rotating covers. Slotted openings may provide elongated discharge ports that distribute gas flow over a larger area. Angled openings may direct gases at specific angles relative to the suppressor axis, such as 45-degree forward angles. Rotating covers may allow users to adjust the vent opening size or direction according to operational requirements.

In an illustrative configuration, acoustic metamaterial design principles may be applied to enhance sound suppression performance. The blast chamber spiral coils may be designed using specialized simulation software to create advanced acoustic structures or acoustic metamaterials. The coil dimensions, spacing, and angular relationships may be tuned to create specific resonant frequencies. The individual coils may be configured to generate destructive interference patterns that cancel specific frequency components of the sound waves. The metamaterial approach may involve positioning coils in patterns that create regions where sound waves from different coils interfere destructively.

The baffle system may incorporate modifications to enhance gas flow and heat management. Baffle slotted holes modifications may be implemented to reduce heat buildup and component weight while maintaining suppression performance. The slotted holes may be positioned on the interior faces of baffle components to provide additional gas flow pathways. The slot dimensions and distribution may be optimized to balance structural integrity with thermal management requirements. The slotted design may allow for more efficient heat dissipation while reducing the overall mass of the baffle components.

Material selection options may be tailored to specific performance requirements and operating conditions. The suppressor components may be manufactured from various materials, including grade 5 titanium, nickel-chromium superalloy, 17-4 stainless steel, and aluminum. Grade 5 titanium may provide an optimal strength-to-weight ratio for applications where weight reduction is a priority. nickel-chromium superalloy may be selected for high-temperature applications where thermal resistance is required. 17-4 stainless steel may offer cost-effective performance for moderate-pressure applications. Aluminum may be utilized for low-pressure calibers where weight and cost considerations are primary factors.

In an illustrative configuration, the identification tag system may incorporate various design features to enhance functionality and compliance. Identification tag features may include flanges for secure positioning, witness marks for alignment, and surface treatments for durability. The flange design may prevent the tag from moving during installation and operation. Witness marks may provide visual indicators for proper positioning during the welding process. Surface treatments such as anodizing or coating may enhance corrosion resistance and marking visibility.

The reverse gas flow chamber may incorporate variable design parameters to optimize performance for different applications. Variable radius depths may be implemented to accommodate different caliber requirements and gas volumes. The radius depth may range from 15 mm for smaller calibers to larger dimensions for high-volume applications. The central hole dimensions may be adjusted to accommodate different barrel sizes and configurations. The bowl-shaped radius may extend around the entire base to provide consistent gas flow redirection.

Thereafter, the blast deflection ring may incorporate adjustable flow characteristics through variable geometric features. Adjustable radius slopes may be implemented to control gas flow velocity and direction. The slope angle may be increased or decreased to speed up or slow down gas flow according to specific performance requirements. The radius slope configuration may be optimized based on caliber specifications and overall gas volume considerations. The slope geometry may affect the transition of gases from the blast chamber spiral into the inlet baffle module.

In an illustrative configuration, the blast chamber spiral may accommodate various opening configurations to optimize gas distribution. Variable spiral openings may be implemented to match different caliber requirements and gas volumes. The number of openings may be adjusted from the standard six openings to accommodate higher or lower gas volumes. The opening sizes may be varied to create different flow characteristics through each spiral pathway. The spiral coil dimensions may be modified to create different pathway lengths and turbulence characteristics.

The male-threaded fastener may incorporate alternative slot designs to enhance tool compatibility and security. Rectangular slot designs may be implemented instead of standard hexagonal patterns to require specialized tools. The rectangular slots may be patterned around the outside radius of the component to provide multiple engagement points. The slot dimensions and spacing may be optimized to prevent accidental engagement with standard tools while ensuring secure attachment with the appropriate specialized wrench.

Additionally, spring-loaded attachment alternatives may be implemented to simplify the mounting system. The spring-loaded mechanism may eliminate the need for multiple threaded components by providing a single-component attachment solution. The spring-loaded button, switch, or flip-up tab may provide quick-disconnect functionality similar to hub-compatible quick-disconnect mounts. The spring mechanism may maintain secure attachment while allowing for rapid removal when required. The centrally located tube design may house the spring mechanism and provide structural support for the attachment system.

In an illustrative configuration, multi-caliber compatibility may be achieved through modular component design. The suppressor system may accommodate different calibers through interchangeable components and adjustable parameters. The bore diameter may be modified through replaceable barrel adapters designed for specific thread patterns and caliber requirements. The gas tube quantity and positioning may be adjusted according to the gas volume characteristics of different calibers. The baffle spacing and chamber volumes may be optimized for each caliber specification through modular component selection.

The methods, systems, devices, graphs, and/or tables are illustrative examples, and configurations may omit, substitute, or add various procedures or components as appropriate. For instance, the methods may be reordered in alternative configurations, and/or various stages may be added, omitted, and/or combined. Alternatively, features described with respect to certain configurations may be in various alternative configurations. Different aspects and elements of the configurations may be combined similarly. Also, technology evolves; thus, many of the elements are examples and do not limit the scope of the disclosure or claims. Additionally, the techniques discussed herein may provide differing results with different types of context awareness classifiers.

Unless defined otherwise, all technical and scientific terms used herein have the same meaning as commonly or conventionally understood. As used herein, the articles "a" and "an" refer to one or more than one (i.e., to at least one) of the grammatical object of the article. By way of example, "an element" means one element or more than one element. "About" and/or "approximately" as used herein when referring to a measurable value such as an amount, a temporal duration, and the like encompass variations of ±20% or ±10%, ±5%, or +0.1% from the specified value as such variations are appropriate in the context of the systems, devices, circuits, methods, and other implementations described herein. "Substantially," as used herein when referring to a measurable value such as an amount, a temporal duration, a physical attribute (such as frequency), and the like, also encompasses variations of ±20% or ±10%, ±5%, or +0.1% from the specified value as such variations are appropriate in the context of the systems, devices, circuits, methods, and other implementations described herein.

As used herein, including in the claims, "and" as used in a list of items prefaced by "at least one of" or "one or more of" indicates that any combination of the listed items may be utilized. For example, a list of "at least one of A, B, and C" includes any of the combinations A, B, C, AB, AC, BC, and/or ABC (i.e., A, B, and C). Furthermore, to the extent more than one occurrence or use of the items A, B, or C is possible, multiple uses of A, B, and/or C may form part of the contemplated combinations. For example, a list of "at least one of A, B, and C" may include AA, AAB, AAA, BB, etc.

While illustrative and presently preferred embodiments of the disclosed systems, methods, and/or machine-readable media have been described in detail herein, it is to be understood that the inventive concepts may be otherwise variously embodied and employed and that the appended claims are intended to be construed to include such variations except as limited by the prior art. While the principles of the disclosure have been provided in connection with specific apparatuses and methods, it is to be clearly understood that this description is made only by way of example and not as a limitation on the scope of the disclosure.

What is claimed is:

1. A gas recirculation system for a firearm suppressor comprising:
- a proximal end configured to attach to a firearm barrel;
- a distal end;
- a housing disposed between the proximal end and the distal end, the housing comprising a plurality of components comprising:
  - a blast chamber adjacent to the proximal end;
  - a receiving baffle disposed near the proximal end, the receiving baffle comprising:
    - a plurality of ports formed through the receiving baffle;
  - an inner tube adjoining the receiving baffle, wherein the inner tube separates a central chamber from a peripheral chamber; and
  - a terminal baffle adjoining both the inner tube and the distal end, the terminal baffle comprising:
    - a neck oppositely disposed from the distal end; and
    - at least a first intermediary baffle disposed between the receiving baffle and the terminal baffle in the central chamber;
- a bore piercing the proximal end, the distal end, and the plurality of components of the housing; and
- a gas recirculation system comprising:
  - a plurality of return tubes configured to redirect gas between the central chamber and the peripheral chamber, wherein the plurality of return tubes are:
    - formed on the terminal baffle; and
    - in fluid communication with the peripheral chamber; and
  - a plurality of injection tubes in fluid communication with the peripheral chamber and the receiving baffle,
  - wherein the gas recirculation system directs gas at the terminal baffle and conveys the gas to or from the peripheral chamber via the plurality of return tubes and ingests or releases the gas to the receiving baffle via the plurality of injection tubes to extend gas dwell time within the firearm suppressor.

2. The gas recirculation system of claim 1 and further comprising:
- a first helical path adjacent to, and in fluid communication with, the blast chamber, wherein the first helical path is configured to receive gas directly from the blast chamber.

3. The gas recirculation system of claim 2 and further comprising:
- a lattice adjoining the first helical path,
- wherein the lattice is configured to both:
  - support the first helical path; and
  - tubulate the gas.

4. The gas recirculation system of claim 3 and further comprising:
- a plurality of windows formed in the neck of the terminal baffle; and
- an expansion cone bridging between the neck and the distal end.

5. The gas recirculation system of claim 1, wherein the plurality of ports of the receiving baffle are arranged in a pattern configured to direct gas flow radially inward from the peripheral chamber into the central chamber.

6. The gas recirculation system of claim 1, wherein the inner tube comprises a cylindrical wall having a substantially constant diameter along a length of the inner tube, wherein the cylindrical wall separates the central chamber from the peripheral chamber along at least half of the firearm suppressor.

7. The gas recirculation system of claim 1, wherein the terminal baffle comprises:
- the plurality of return tubes arranged circumferentially around the neck,
- wherein each return tube comprises a curved pathway configured to redirect gas flow at least 100 degrees from the central chamber to the peripheral chamber.

8. The gas recirculation system of claim 1, wherein the first intermediary baffle comprises:
- a conical baffle having a central bore opening and an outer perimeter,
- wherein the conical baffle is configured to direct gas flow around the outer perimeter before passing through the central bore opening.

9. The gas recirculation system of claim 1, wherein the plurality of injection tubes are positioned to release a gas from the peripheral chamber into a region between the blast chamber and the receiving baffle, wherein the gas, released, mixes with gas flowing from the blast chamber to extend gas dwell time within the firearm suppressor.

10. A gas recirculation method in a firearm suppressor comprising:
- attaching a proximal end to a firearm barrel;
- providing a distal end;
- disposing a housing between the proximal end and the distal end, the housing comprising a plurality of components comprising:
  - a blast chamber adjacent to the proximal end;
  - a receiving baffle disposed near the proximal end, the receiving baffle comprising:
    - a plurality of ports formed through the receiving baffle;
  - an inner tube adjoining the receiving baffle, wherein the inner tube separates a central chamber from a peripheral chamber; and a terminal baffle adjoining both the inner tube and the distal end, the terminal baffle comprising:

a neck oppositely disposed from the distal end; and at least a first intermediary baffle disposed between the receiving baffle and the terminal baffle in the central chamber;

a bore piercing the proximal end, the distal end, and the plurality of components of the housing;

redirecting gas from the central chamber to the peripheral chamber via a plurality of return tubes formed on the terminal baffle and in fluid communication with the peripheral chamber; and releasing gas from the peripheral chamber to the receiving baffle via a plurality of injection tubes in fluid communication with the peripheral chamber and the receiving baffle, wherein the method extends gas dwell time within the firearm suppressor by directing gas at the terminal baffle, conveying the gas to the peripheral chamber via the plurality of return tubes, and releasing the gas to the receiving baffle via the plurality of injection tubes.

11. The method of claim 10 and further comprising:

receiving gas directly from the blast chamber at a first helical path adjacent to, and in fluid communication with, the blast chamber.

12. The method of claim 11 and further comprising:

supporting the first helical path with a lattice adjoining the first helical path; and tubulating the gas with the lattice.

13. The method of claim 12 and further comprising:

forming a plurality of windows in the neck of the terminal baffle; and bridging between the neck and the distal end with an expansion cone.

14. The method of claim 10, wherein the plurality of ports of the receiving baffle are arranged in a pattern configured to direct gas flow radially inward from the peripheral chamber into the central chamber.

15. The method of claim 10, wherein the inner tube comprises a cylindrical wall having a substantially constant diameter along a length of the inner tube, wherein the cylindrical wall separates the central chamber from the peripheral chamber along at least half of the firearm suppressor.

16. The method of claim 10, wherein the terminal baffle comprises:

the plurality of return tubes arranged circumferentially around the neck, wherein each return tube comprises a curved pathway configured to redirect gas flow at least 100 degrees from the central chamber to the peripheral chamber.

17. The method of claim 10, wherein the at least a first intermediary baffle comprises:

a conical baffle having a central bore opening and an outer perimeter, wherein the conical baffle is configured to direct gas flow around the outer perimeter before passing through the central bore opening.

18. The method of claim 10, wherein the plurality of injection tubes are positioned to release gas from the peripheral chamber into a region between the blast chamber and the receiving baffle, wherein the released gas mixes with gas flowing from the blast chamber to extend gas dwell time within the firearm suppressor.

19. A helical path for a firearm suppressor comprising:

a proximal end configured to attach to a firearm barrel;

a distal end; and a housing disposed between the proximal end and the distal end, the housing comprising a plurality of components comprising:

a blast chamber adjacent to the proximal end;

a first helical path adjacent to, and in fluid communication with, the blast chamber, wherein the first helical path is configured to receive gas directly from the blast chamber;

a lattice adjoining the first helical path, wherein the lattice is configured to both:

support the first helical path and tubulate the gas;

a receiving baffle adjoining the lattice, the receiving baffle comprising:

a plurality of ports formed through the receiving baffle;

an inner tube adjoining the receiving baffle, wherein the inner tube separates a central chamber from a peripheral chamber;

a terminal baffle adjoining both the inner tube and the distal end, the terminal baffle comprising:

a neck oppositely disposed from the distal end;

a plurality of windows formed in the neck; and an expansion cone bridging between the neck and the distal end;

at least a first intermediary baffle disposed between the receiving baffle and the terminal baffle in the central chamber; and a bore piercing the proximal end, the distal end, and the plurality of components of the housing, wherein the helical path extends the gas dwell time within the firearm suppressor.

20. The helical path of claim 19 further comprising:

a gas recirculation system disposed between the helical path and the distal end, the gas recirculation system comprising:

a plurality of return tubes configured to redirect gas from the central chamber to the peripheral chamber, wherein the plurality of return tubes are:

formed on the terminal baffle; and in fluid communication with the peripheral chamber; and a plurality of injection tubes in fluid communication with the peripheral chamber and the lattice, wherein the gas recirculation system directs gas at the terminal baffle and conveys the gas to the peripheral chamber via the plurality of return tubes and releases the gas to the lattice via the plurality of injection tubes to extend gas dwell time within the firearm suppressor.

* * * * *